US006378627B1

(12) United States Patent
Tubel et al.

(10) Patent No.: US 6,378,627 B1
(45) **Date of Patent: *Apr. 30, 2002**

(54) AUTONOMOUS DOWNHOLE OILFIELD TOOL

(75) Inventors: Paulo S. Tubel, The Woodlands; Jeffrey E. Johnson, Houston, both of TX (US); Colin M. Angle, Watertown; Thomas W. McIntyre, Harvard, both of MA (US)

(73) Assignee: Intelligent Inspection Corporation, Somerville, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,078

(22) Filed: Sep. 23, 1997

Related U.S. Application Data

(63) Continuation-in-part of application No. 08/891,530, filed on Jul. 11, 1997, now Pat. No. 5,947,213.

(60) Provisional application No. 60/026,558, filed on Sep. 23, 1996, and provisional application No. 60/032,183, filed on Dec. 2, 1996.

(51) Int. Cl.[7] ..... E21B 44/00

(52) U.S. Cl. ..... 175/24; 175/40; 166/250.01; 166/255.2

(58) Field of Search ..... 175/24, 40, 26, 175/27, 45, 48, 50; 166/250.01, 255.1, 255.2

(56) References Cited

U.S. PATENT DOCUMENTS

| | | | |
|---|---|---|---|
| 3,225,843 | A | 12/1965 | Ortloff et al. |
| 3,313,346 | A | 4/1967 | Cross |
| 3,724,567 | A | 4/1973 | Smitherman |
| 4,006,359 | A | 2/1977 | Sullins et al. |
| 4,050,384 | A | 9/1977 | Chapman |
| 4,071,086 | A | 1/1978 | Bennett |
| 4,085,808 | A | 4/1978 | Kling |
| 4,112,850 | A | 9/1978 | Sigel-Gfeller |
| 4,141,414 | A | 2/1979 | Johansson |
| 4,177,734 | A | 12/1979 | Rhoden |
| 4,192,380 | A | 3/1980 | Smith |
| 4,244,296 | A | 1/1981 | Vertut |
| 4,369,713 | A | 1/1983 | Richardson |
| 4,463,814 | A | 8/1984 | Horstmeyer et al. |
| 4,537,136 | A | 8/1985 | Douglas |
| 4,558,751 | A | 12/1985 | Huffaker |
| 4,565,487 | A | 1/1986 | Kroczynski |
| 4,676,310 | A | 6/1987 | Scherbatskoy et al. |
| 4,686,653 | A | 8/1987 | Staron et al. |
| 4,770,105 | A | 9/1988 | Takagi et al. |
| 4,838,170 | A | 6/1989 | Illakowicz |
| 4,862,808 | A | 9/1989 | Hedgcoxe et al. |
| 4,919,223 | A | 4/1990 | Egger et al. |

(List continued on next page.)

FOREIGN PATENT DOCUMENTS

| | | |
|---|---|---|
| GB | 0 149 528 | 7/1985 |
| WO | 9624745 | 2/1996 |
| WO | WO 96/24745 | 8/1996 |
| WO | 9802634 | 7/1997 |
| WO | WO 98/02634 | 1/1998 |

OTHER PUBLICATIONS

Gary Rich et al., Rotary Closed Loop Drilling System Designed For The NExt Millennium, May 1997 Hart's Petroleum Engineer International pp. 47–53.

*Primary Examiner*—Frank Tsay
(74) *Attorney, Agent, or Firm*—George A. Herbster

(57) ABSTRACT

An autonomous downhole oilfield tool having its own mobility and decision making capability so that it may be deployed in a downhole environment to monitor and control said environment by modifying operations of other devices and maintaining downhole structures.

40 Claims, 28 Drawing Sheets

U.S. PATENT DOCUMENTS 4,940,095 A 7/1990 Newman
5,018,451 A 5/1991 Hapstack
5,080,020 A 1/1992 Negishi
5,111,401 A 5/1992 Everett, Jr. et al.
5,121,694 A 6/1992 Zollinger
5,142,989 A 9/1992 Suzumori et al.
5,142,990 A 9/1992 Leonard
5,172,639 A 12/1992 Wiesman et al.
5,184,676 A 2/1993 Graham et al.
5,186,264 A 2/1993 du Chaffaut
5,203,646 A 4/1993 Landsberger et al.
5,210,821 A 5/1993 Yazaki et al.
5,220,869 A 6/1993 Pelrine et al.
5,254,835 A 10/1993 Dalke et al.
5,272,986 A 12/1993 Smart
5,291,112 A 3/1994 Karidis et al.
5,293,823 A 3/1994 Box
5,309,844 A 5/1994 Zollinger
5,316,094 A 5/1994 Pringle
5,350,033 A 9/1994 Kraft
5,373,898 A 12/1994 Pringle
5,375,530 A 12/1994 Zollinger et al.
5,388,528 A 2/1995 Pelrine et al.
5,392,715 A 2/1995 Pelrine
5,394,951 A 3/1995 Pringle et al.
5,435,395 A 7/1995 Connell
5,706,892 A 1/1998 Aeschbacher et al.
5,732,776 A 3/1998 Tubel et al.
5,794,703 A 8/1998 Newman et al.
5,812,068 A 9/1998 Wisler et al.
5,829,520 A 11/1998 Johnson
5,842,149 A 11/1998 Harrell et al.

AUTONOMOUS DOWNHOLE OILFIELD TOOL

CROSS REFERENCE TO PRIOR APPLICATIONS

This application is a continuation-in-part of U.S. Ser. No. 08/891,530 filed Jul. 11, 1997, now U.S. Pat. No. 5,947,213, the entire contents of which is incorporated herein by reference, and further claims the benefit of an earlier filing date from U.S. provisional application Ser. No. 60/026,558 filed Sep. 23, 1996 and U.S. provisional application Ser. No. 60/032,183 filed Dec. 2, 1996 the entire contents of each of which are incorporated herein by reference.

FIELD OF THE INVENTION

This invention relates generally to downhole tools for use in oil fields and more particularly to autonomous downhole tools having a mobility device that can move the tool in the wellbore and various end work devices for performing desired operations at selected work sites in the wellbore.

PRIOR ART

To produce hydrocarbons (oil and gas) from the earth's formations, wellbores are formed to desired depths. Branch or lateral wellbores are frequently drilled from a main wellbore to form deviated or horizontal wellbores for recovering hydrocarbons or improving production of hydrocarbons from subsurface formations. A large proportion of the current drilling activity involves drilling highly deviated and horizontal wellbores.

The formation of a production wellbore involves a number of different operations. Such operations include completing the wellbore by cementing a pipe or casing in the wellbore, forming windows in the main wellbore casing to drill and complete lateral or branch wellbores, other cutting and milling operations, re-entering branch wellbores to perform desired operations, perforating, setting devices in the wellbore such as plugs and sliding sleeves, remedial operations such as stimulating and cleaning, testing and inspection including determining the quality and integrity of junctures, testing production from perforated zones, collecting and analyzing fluid samples, and analyzing cores.

Oilfield wellbores usually continue to produce hydrocarbons for many years. Various types of operations are performed during the life of producing wellbores. Such operations include removing, installing and replacing different types of devices, including fluid flow control devices, sensors, packers or seals, remedial work including sealing off zones, cementing, reaming, repairing junctures, milling and cutting, diverting fluid flows, controlling production from perforated zones, activating or sliding sleeves, testing wellbore production zones or portions thereof, and making periodic measurements relating to wellbore and formation parameters.

To perform downhole operations, whether during the completion phase, production phase, or for servicing and maintaining the wellbore, a bottomhole assembly is conveyed into the wellbore. The bottomhole assembly is then positioned in the wellbore at a desired work site and the desired operation is performed. This requires a rig at the wellhead and a conveying means, which is typically a coiled tubing or a jointed pipe. Such operations usually require a rig at the wellbore and means for conveying the tubings into the wellbore.

During the wellbore completion phase, the rig is normally present at the wellhead. Occasionally, the large drilling rig is removed and a smaller work rig is erected to perform completion operations. However, many operations during the completion phase could be performed without the use of a rig if a mobility device could be utilized to move and position the bottomhole assembly into the wellbore, especially in the horizontal sections of the wellbores. During the production phase or for workover or testing operations, a rig is especially erected at the well site prior to performing many of the operations, which can be time consuming and expensive. The primary function of the rig in some of such operations is to convey the bottomhole assembly into the wellbore and to a lesser extent position and orient the bottomhole assembly at the desired work site. A mobility device that can move and position the bottomhole assembly at the desired work site can allow the desired downhole operations to be performed without requiring a rig and bulky tubings and tubing handling systems. Additionally, downhole tools with a mobility system, an imaging device and an end work device could perform many of the downhole operations automatically without a rig. Additionally, such downhole tools can be left in the production wellbores for extended time periods to perform many operations according to commands supplied from the surface or stored in the tool. Such operations may include periodically operating sliding sleeves and control valves, and performing testing and data gathering operations.

U.S. Pat. Nos. 5,186,264 to du Chaffaut, 5,316,094 to Pringle (Pringle '094), 5,373,898 to Pringle (Pringle '898) and 5,394,951 to Pringle et al. disclose certain structures for guiding downhole tools in the wellbores. The du Chaffaut patent discloses a device for guiding a drilling tool into a wellbore. Radially displaceable pistons, in an extension position, come into anchoring engagement with the wall of the wellbore and immobilize an external sleeve. A jack displaces the body and the drilling tool integral therewith with respect to the external sleeve and exerts a pushing force onto the tool. Hydraulic circuits and control assemblies are provided for controlling the execution of a series of successive cycles of anchoring the external sleeve in the well and of displacement of the drilling tool with respect to the external sleeve.

The Pringle '094 patent discloses an orientation mandrel that is rotatable in an orientation body for providing rotational orientation. A thruster connects to the orientation mandrel for engaging the wellbore by a plurality of elongate gripping bars. An annular thruster piston is hydraulically and longitudinally movable in the thruster body for extending the thruster mandrel outwardly from the thruster body, independently of an orientating tool.

The Pringle '898 patent discloses a tool with an elongate circular body and a fluid bore therethrough. A fixed plate extends radially between the bore and the body. A rotatable piston extends between the enclosed bore and the body and is rotatable about the enclosed bore. A hydraulic control line extends longitudinally to a position between the plate and the piston for rotating the piston. The tool may act as orientation tool and include a rotatable mandrel actuated by the piston. A spring recocks the piston and a valve means for admitting and venting fluid from the piston.

The Pringle et al. patent discloses a bottomhole drilling assembly connectable to a coiled tubing that is controlled from the surface. A downhole motor rotates a drill bit and an articulate sub that causes the drill bit to drill a curved bore hole. A steering tool indicates the attitude of the bore hole. A thruster provides force to advance the drill bit. An orientating tool rotates the thruster relative to a coiled tubing to control the path of the borehole.

Another series of patents disclose apparatus for moving through the interior of a pipe. These include U.S. Pat. Nos. 4,862,808 to Hedgcoxe et al., 5,203,646 to Landsberger et al. and 5,392,715 to Pelrine. The Hedgcoxe et al. patent discloses a robotic pipe crawling device with two three-wheel modules pivotally connected at their centers. Each module has one idler wheel and two driven wheels, an idler yoke and a driveline yoke chassis with parallel, laterally spaced, rectangular side plates. The idler side plates are pinned at one end of the chassis and the idler wheel is mounted on the other end. The driveline side plates are pinned to the chassis and the drive wheels are rotatably mounted one at each end. A motor at each end of the chassis pivots the wheel modules independently into and out of a wheel engaging position on the interior of the pipe and a drive motor carried by the driveline yoke drives two drive wheels in opposite directions to propel the device. A motor mounted within each idler yoke allows them to pivot independently of the driveline yokes. A swivel joint in the chassis midsection allows each end to rotate relative to the other. The chassis may be extended with additional driveline yokes. In addition to a straight traverse, the device is capable of executing a "roll sequence" to change its orientation about its longitudinal axis, and "L", "T" and "Y" cornering sequences. Connected with a computer the device can "learn" a series of axis control sequences after being driven through the maneuvers manually.

The Landsberger et al. patent discloses an underwater robot that is employed to clean and/or inspect the inner surfaces of high flow rate inlet pipes. The robot crawls along a cable positioned within the pipe to be inspected or cleaned. A plurality of guidance fins rely upon the flow of water through the pipe to position the robot as desired. Retractable legs can fix the robot at a location within the pipe for cleaning purposes. A water driven turbine can generate electricity for various motors, servos and other actuators contained on board the robot. The robot also can include wheel or pulley arrangements that further assist the robot in negotiating sharp comers or other obstructions.

The Pelrine patent discloses an in-pipe running robot with a vehicle body movable inside the pipe along a pipe axis. A pair of running devices are disposed in front and rear positions of the vehicle body. Each running device has a pair of wheels secured to opposite ends of an axle. The wheels are steerable as a unit about a vertical axis of the vehicle body and have a center of steering thereof extending linearly in the fore and aft direction of the vehicle body. When the robot is caused to run in a circumferential direction inside the pipe, the vehicle body is set to a posture having the fore and aft direction inclined with respect to the pipe axis. The running devices are then set to a posture for running in the circumferential direction. Thus, the running devices are driven to cause the vehicle body to run stably in the circumferential direction of the pipe.

Additionally, U.S. Pat. Nos. 5,291,112 to Karidis et al. and 5,350,033 to Kraft disclose robotic devices with certain work elements. The Karidis et al. patent discloses a positioning apparatus and movement sensor in which a positioner includes a first section having a curved comer reflector, a second section and a third section with a an analog position-sensitive photodiode. The second section includes light-emitting-diodes (LEDs) and photodetectors. Two LEDs and the photodetectors faced in a first direction toward the comer reflector. The third LED faces in a second direction different from the first direction toward the position-sensitive photodiode. The second section can be mounted on an arm of the positioner and used in conjunction with the first and third sections to determine movement or position of that arm.

The above-noted patents and known prior art downhole tools (a) lack downhole maneuverability, in that the various elements of the tools do not have sufficient degrees of freedom of movement, (b) lack local or downhole intelligence to predictably move and position the downhole tool in the wellbore, (c) do not obtain sufficient data respecting the work site or of the operation being performed, (d) are not suitable to be left in the wellbores to periodically perform testing, inspection and data gathering operations, (e) do not include reliable tactile imaging devices to image the work site during and after performing an end work, and to provide confirmation of the quality and integrity of the work performed. Prior art tools require multiple trips downhole to perform many of the above-noted operations, which can be very expensive, due to the required rig time or production down time.

The present invention addresses some of the above-noted needs and problems with the prior art downhole tools and provides downhole tools that (a) utilize a mobility device or transport module or mechanism that moves in the wellbore with predictable positioning and (b) may include any one or more of a plurality of function modules such as a module or device for imaging the desired work site and or an end work device or module that can perform a desired operation at the work site. The present invention further provides a novel mobility device or transport module or mechanism, a tactile imaging function module and a cutting device as a function module for performing precision cutting operations downhole, such as forming windows in casings to initiate the drilling of branch wellbores. It is highly desirable to cut such windows relatively precisely to preserve the eventual juncture integrity and to weld the main wellbore and branch wellbore casings at the juncture.

SUMMARY OF THE INVENTION

The present invention provides a system for performing a desired operation in a wellbore. The system contains an autonomous downhole tool which includes a mobility platform that is operated electrically, mechanically, hydraulically, pneumatically or combinations thereof to move the autonomous downhole tool in the wellbore and to control the one or more end work devices to perform the desired operation. The autonomous downhole tool may also include an imaging device to provide pictures of the downhole environment any of a multiplicity of sensors to sense various parameters. The data from the autonomous downhole tool may be communicated to a surface computer, which controls the operation of the tool and displays pictures of the tool environment or may be processed downhole and cause the autonomous tool to take various actions such as initiating changes in the operation of various other downhole tools to modify the conditions of the producing well. The autonomous tool may also be employed to repair other downhole tools and can also maintain the wellbore itself.

Novel tactile imaging devices are also provided for use with the autonomous downhole tool. One such tactile imaging device includes a rotating member that has an outwardly biased probe. The probe makes contact with the wellbore as it rotates in the wellbore. Data relating to the distance of the probe end from the tool is obtained, which is processed to obtain three dimensional pictures of the wellbore inside. A second type of tactile imaging device can be coupled to the front of the downhole tool to obtain images of objects or the wellbore ahead or downhole of the tool. This imaging device includes a probe connected to a rotating base. The probe has a pivot arm that is coupled to the base with at least one degree of freedom and a probe arm connected to the pivot arm with at least one degree of freedom. Data relating to the position of the end of the probe arm is processed to obtain pictures or images of the wellbore environment.

The present invention also provides a downhole cutting tool for cutting materials at a work site in a wellbore. The cutting tool includes a base that is rotatable about a longitudinal axis of the tool. A cutting element is carried by the base which is moveable radially outwardly. To perform a cutting operation, the mobility platform is used to provide axial movement, the base is used to provide rotary movement about the tool axis and the cutting element movement provides outward or radial movement.

In an alternative embodiment, the downhole tool is made of a base unit and a detachable work unit. The work unit is the autonomous tool forming the basis of the invention, which, as noted above, may include any number of sensors and work tools. In the present embodiment, the work unit includes the mobility platform, imaging device and the end work device. The tool is conveyed into the wellbore by a conveying member, such as wireline or a coiled tubing. The work unit detaches itself from the base unit, travels to the desired location in the wellbore and performs a predefined operation according to programmed instruction stored in the work unit. The work unit then returns to the base unit, where it transfers data relating to the operation and can be recharged for further operation.

Mobility of the tool may be by wheels, electromagnetic feet, a track, a screw, a thruster, etc. and the controller is preferably on board but may be remote from the autonomous tool in some embodiments where a tether is employed to provide power and communication.

It should be noted that the autonomous tool which plays a part in all of the embodiments of the invention includes a controller and a power source and preferably also includes at least one sensor although this is not necessary. In preferred embodiments the tool is self mobilized and may be tethered or untethered.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiments, taken in conjunction with the accompanying drawings, in which like elements have been given like numerals, and wherein.

DETAILED DESCRIPTION OF PREFERRED EMBODIMENTS

In its most general sense the invention comprises an autonomous downhole tool having a power source, a controller and the ability to move under its own power. A preferred embodiment requires that the tool of the invention be resident in the hole and not merely be transient as in a wireline device. Preferably, the autonomous tool includes at least one sensor or the ability to upload information from the sources downhole such as sensors and other tools. Building on the concept of such an autonomous downhole tool, several embodiments are set forth wherein differing tools or sensors are controlled with the autonomous tool. Moreover, several of the autonomous tools are employable in a cooperating manner to accomplish desired ends. It is important to recognize that some tasks may be too large for a single autonomous tool to accomplish. In these events it is advantageous to provide a series of individual autonomous tools that are connected through two way or even one way communication with other autonomous tools. The tools then have he ability to work together to achieve a result that would otherwise have been impossible by a single autonomous tool alone. The autonomous tools of the invention may also be employed with non mobile counterparts which assist the autonomous downhole tools in completing their objectives by applying various materials including chemicals, tools, etc. from a storage area. The system created by employment of the autonomous tool since various combinations creates maintenance possibilities both in non producing wellbores and in producing wellbores.

The present invention provides a system with a downhole tool that includes a common mobility platform or module that is adapted to move and position the downhole tool within wellbores to perform a desired operations in the wellbore. Any number of function modules may be included in the downhole tool to perform various desired operations in the wellbores, including but not limited to imaging, end work devices such as cutting devices, devices for operating other downhole devices, etc., and sensors for making measurements relating to the wellbore and/or formation parameters.

Figure 1:
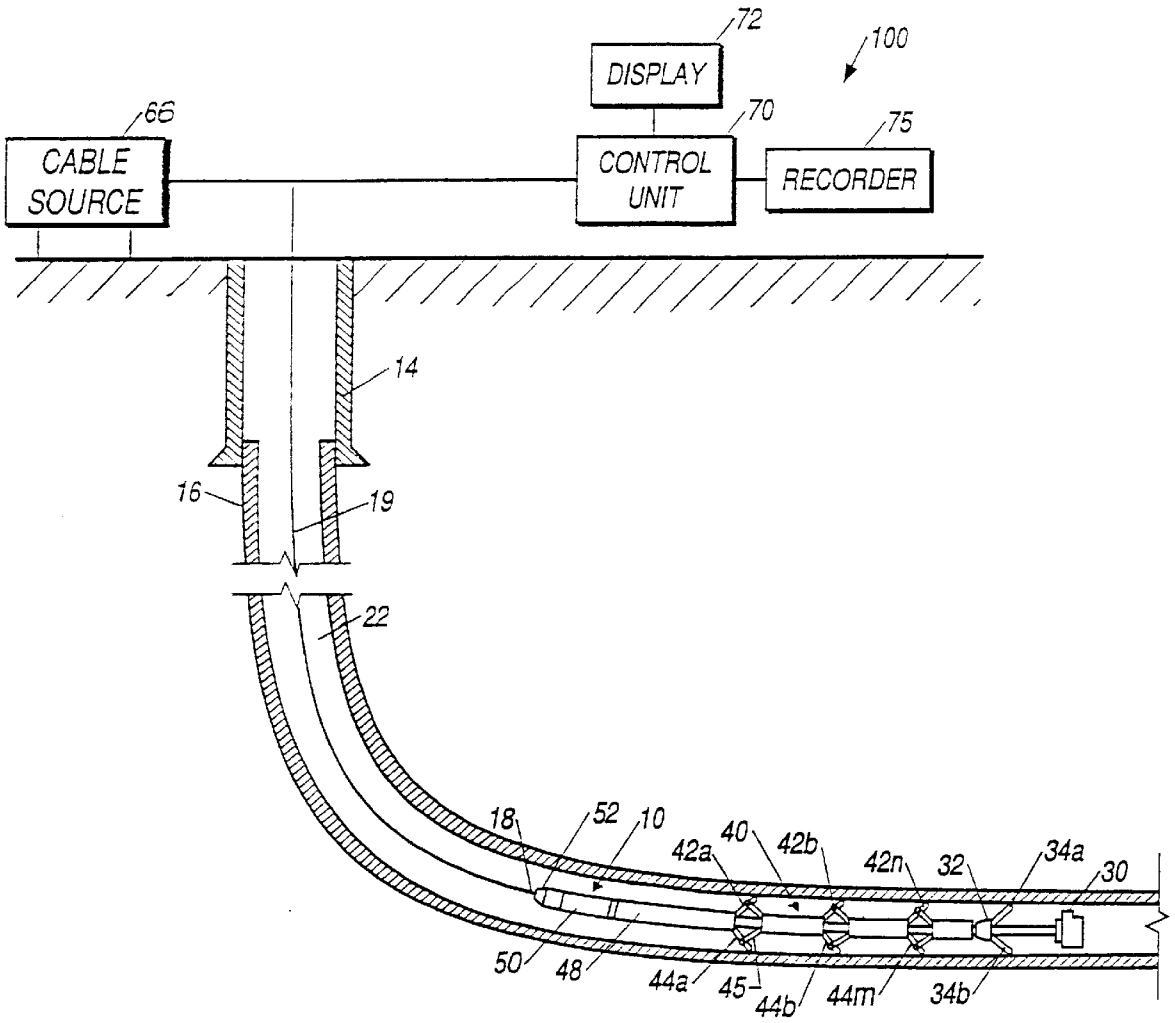
FIG. 1 is a schematic diagram of a system for performing downhole operations showing a downhole tool according to the present invention placed in a wellbore.

FIG. 1 is a schematic illustration of an embodiment of a system 100 for performing downhole operations according to the present invention. The system 100 is shown to include one embodiment of an autonomous downhole tool to the present invention the present invention and located in a cased wellbore 22. Generally, the autonomous downhole tool 10 will be used in a cased wellbore 22 that extends from a surface location (wellhead) into the earth. The wellbore 22 may be vertical, deviated or horizontal. FIG. 1 depicts one specific embodiment of the autonomous downhole tool 10, the configuration and operation of which will be described later. However, as will become apparent, each embodiment of the tool 10 has a common architecture as shown in FIG. 2A, as described below.

Figure 2A:
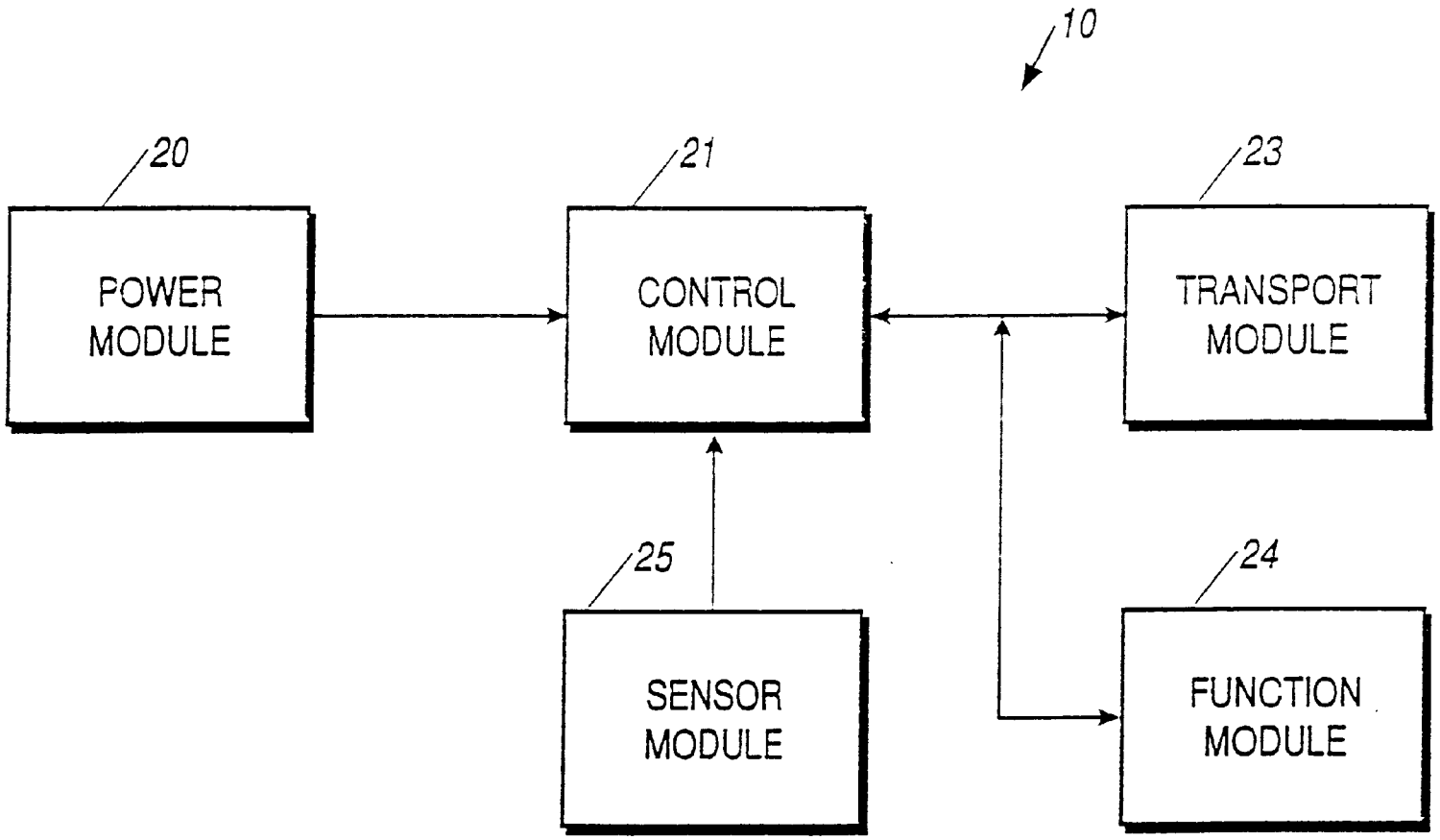
FIGS. 2A and 2B are functional block diagrams depicting the basic components of a downhole tool constructed according to the present invention.

As shown in FIG. 2A, the tool 10 includes a power module 20, a control module 21, a transport module 23, and a function module 24. The tool 10 may also include one or more sensor modules 25. The power module 20 provides power to a control module 21 and through the control module 21 to the sensor module 25, transport module 23 and the function module 24. The control module 21 utilizes signals received from the sensor module 25, transport module 23 and function module 24 to generate commands to the transport module 23 and function module 24 as appropriate. As described later, the control module 21 utilizes a conventional artificial intelligence techniques that utilize behavior control concepts by which a control problem is decomposed into a number of task achieving behaviors all running in parallel. In essence, the control module 21 enables the downhole tool 10 to respond to high-level commands by utilizing its internal control to make task-specific decisions.

The sensor module 25 can provide any number of inputs to the control module 21. As described more fully later, these inputs can be constituted by signals representing various environmental parameters or internal operating parameters or by signals generated by an imaging device or module including a video or tactile sensor. The specific selection of the sensor 25 will depend upon the nature of the task to be performed and the specific implementation of the transport module 23 and function module 24.

The transport module 23 produces predictable positioning of the autonomous tool 10. The phrase "predictable positioning" is meant to encompass at least two types of positioning. The first type is positioning in terms of locating the autonomous downhole tool 10 as it moves through a wellbore. For example, if the transport module 23 implements an open-loop control, "predictable positioning" means that a command to move a certain distance will cause the downhole tool 10 to move that certain distance. The second type is fixed positioning within the wellbore. For example, if the transport module 23 positions a cutting device as a function module, "predictable positioning" means that the transport module 23 will remain at a specific location while the function module 24 is performing a defined operation.

The function module 24 can comprise any number of devices including measuring devices, cutting tools, grasping tools and the like. Other function modules could include video or tactile sensors. Examples of different function modules are provided later.

In a simple embodiment, the autonomous downhole tool 10 constructed according to this invention can comprise a self-contained power module 20, a transport module 23 and a function module 24. Such an autonomous downhole tool 10 could omit the sensor module 25 and be pre-programmed to perform a specific function.

Figure 2B:
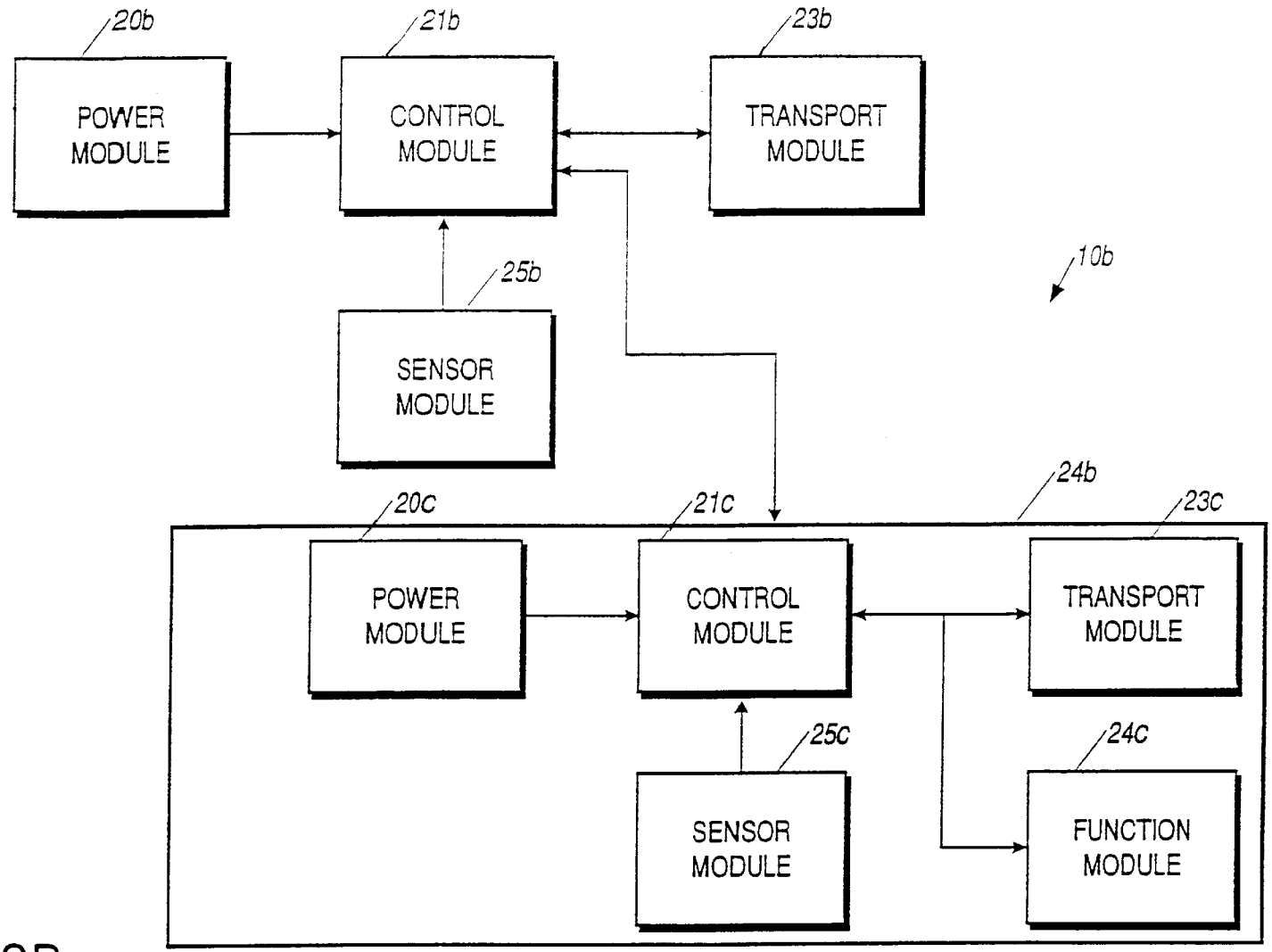

FIG. 2B depicts a more complex embodiment in which the autonomous downhole tool 10 comprises a power module 20B connected to the surface through a tether cable or wireline 19 with power and communications capabilities. The sensor module 25B could include various sensors for monitoring the operation of other modules in the downhole tool 10 in order to produce various actions in the event of monitored operational problems. The control module 21B could additionally receive supervisory signals in the form of high level commands from the surface via the cable 19. These modules and the transport module 23B could then act as a docking station for a function module 24B to move the function module 24B to a specific location in the wellbore 22. The function module 24B could then itself comprise another power module 20C, control module 21C, sensor module 25C and transport module 23C adapted to move from the docking station and operate independently of the docking station with a function module 24C.

In the specific embodiment of FIG. 1, the system 100 includes a downhole tool 10 conveyed in the cased well bore by a wireline 19 from a source 66 at the surface. The wellbore 22 is lined with a casing 14 at the upper section and with a production casing 16 over the remaining portion. In this specific embodiment the downhole tool 10 operates with a cable 19 and a control unit 70 that may contain a computer for generating the high level commands for transfer to a control module 21 associated with the downhole tool 10. The control unit 70 could also receive signals from the downhole tool 10. In such a system a recorder 75 could record and store any desired data and a monitor 72 could be utilized to display any desired information.

The downhole tool 10 in FIG. 1 includes one or more functional modules shown as an end work device 30 for performing the desired downhole operations and an imaging device 32 for obtaining images of any desired portion of the casing or an object in the wellbore 22. A common mobility platform or transport module 40 moves the downhole tool 10 in the wellbore 22. The autonomous downhole tool 10 also may include any number of other sensors and devices in one or more sensor modules generally denoted herein by numeral 48. A two-way telemetry system 52 provides two-way communication between the autonomous downhole tool 10 and the surface control unit 70 via the wireline 19.

The downhole sensors and devices 48 may include sensors for measuring temperature and pressure downhole, sensors for determining the depth of the tool in the wellbore 22, direct or indirect position (x, y, and z coordinates) of the tool 10, an inclinometer for determining the inclination of the tool 10 in the wellbore 22, gyroscopic devices, accelerometers, devices for determining the pull force, center line position, gripping force, tool configuration and devices for determining the flow of fluids downhole. The tool 10 further may include one or more formation evaluation tools for determining the characteristics of the formation surrounding the tool in the wellbore 22. Such devices may include gamma ray devices and devices for determining the formation resistivity. The tool 10 may include devices for determining the wellbore 22 inner dimensions, such as calipers, casing collar locator devices for locating the casing joints and determining the correlating device 10 depth in the wellbore 22, casing inspection devices for determining the condition of the casing, such as casing 14 for pits and fractures. The formation evaluation sensors, depth measuring devices, casing collar locator devices and the inspection devices may be used to log the wellbore 22 while tripping into and or out of the wellbore 22.

The two-way telemetry 52 includes a transmitter for receiving data from the various devices in the tool 10, including the image data, and transmits signals representative of such data to the surface control unit 70. For wireline communication, any suitable conductor may be utilized, including wire conductors, coaxial cables and fiber optic cables. For non-wireline telemetry means, electromagnetic transmitters, fluid acoustic transmitters, tubular fluid transmitters, mud pulse transmitters or any other suitable means may be utilized. The telemetry system also includes a receiver which receives signals transmitted from the surface control unit 70 to the tool 10. The receiver communicates such received signals to the various tools in the tool 10.

FIG. 1 discloses one embodiment of a function module in the form of a tactile sensor having one or more sensory probes, such as probes 34*a–b*. Two tactile imaging devices having sensory probes for use in the tool 10 of the present invention are described later in references to FIGS. 3–5. However, any other suitable imaging device, such as an optical device, microwave device, an acoustic device, ultrasonic device, infra-red device, or RF device may be utilized in the tool 10 as a function module. The imaging device 32 may be employed to provide pictures of the work site or an object in the wellbore 22 or to determine the general shape of the object or the work site or to distinguish certain features of the work site prior to, during and after the desired operation has been performed at the work site.

Still referring to FIG. 1, the end work device 30 may include any device for performing a desired operation at the work site in the wellbore. The end work device 30 may include a cutting tool, milling tool, drilling tool, workover tool, testing tool, tool to install, remove or replace a device, a tool to activate a device such as a sliding sleeve, a valve, a testing device to perform testing of downhole fluids, etc. Further, the tool 10 may include one or more end work devices 30. A novel cutting and milling device for use with tool 10 is described later with reference to FIG. 3. The legs 42 and the rigidity of the tool 10 body keep the tool 10 centered in the wellbore 22.

First Transport Module 40

The construction and operation of the mobility platform 40 will now be described while referring to FIGS. 1, 3 and 9–12. The mobility platform or transport module 40 preferably has a generally tubular body 102 with a number of reduced diameter sections 102*a*–102*n*. Each of the reduced diameter sections 102*a*–102*n* has a respective transport mechanism 42*a*–42*n* around its periphery. Each of the transport mechanisms 42*a* through 42*n* includes a number of outwardly or radially extending levers or arm members 44*a*–44*m*. The levers 44*a*–44*m* for each of the transport mechanisms 42*a*–42*n* extend beyond the largest inside dimension of the wellbore portion in which the tool 10 is to be utilized, in their fully extended position.

Figure 9:
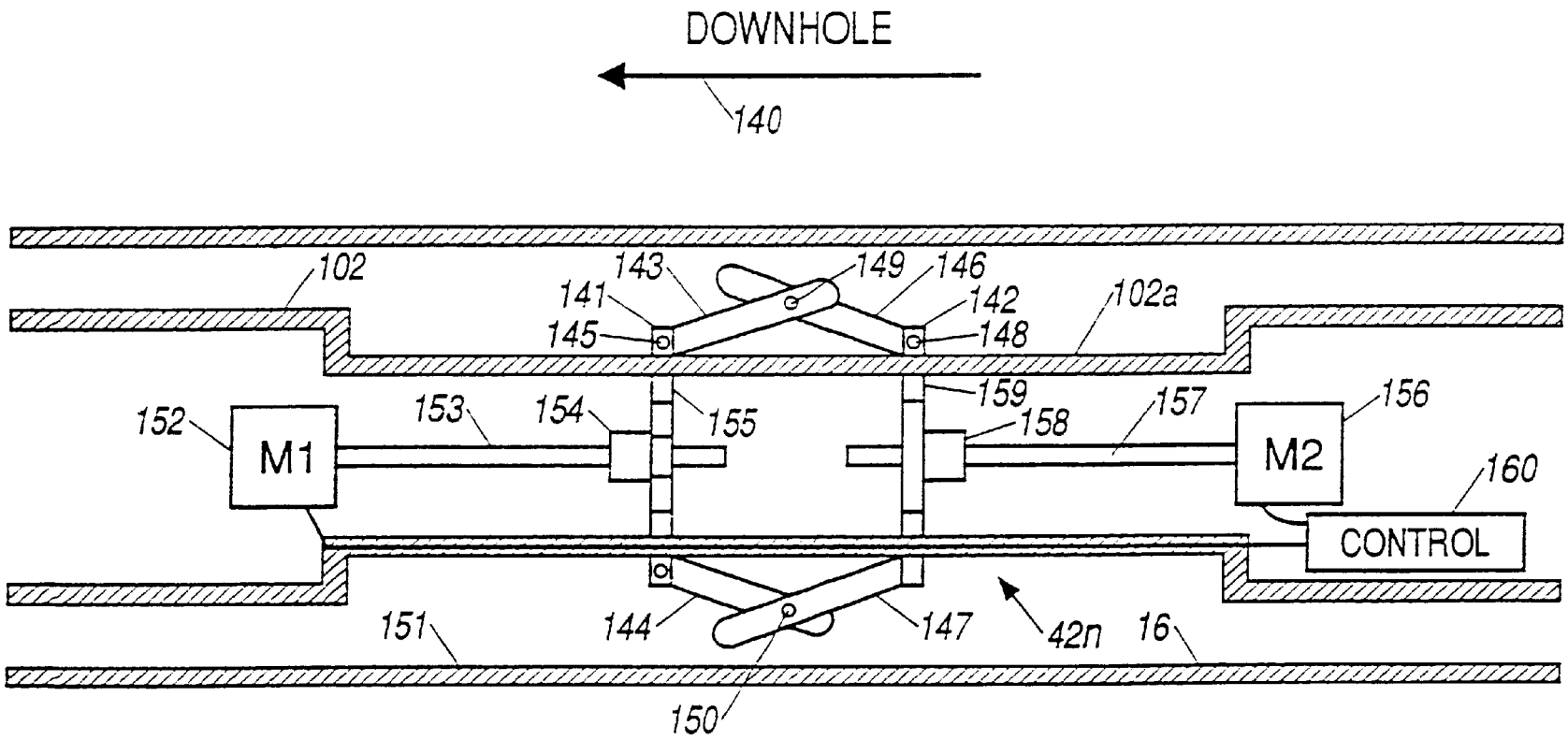
FIG. 9 is a plan view of a transport mechanism useful in the devices shown in FIGS. 1, 3, 6 and 7.

FIG. 9 depicts a portion of the mobility platform 40 of the downhole tool 10 in a horizontal portion of the wellbore casing 16 with particular emphasis on the transport mechanism 42*n* between enlarged diameter portions of the tubular body 102 at the extremities of a reduced diameter suction 102*a*. In FIG. 9 an arrow 140 points downhole. In the following discussion, the terms "proximal" and "distal" are used to define relative positions with respect to the wellhead. That is something that is "proximal" is toward the wellhead or uphole or toward the right in FIG. 9 while something that is "distal" is "downhole" or toward the left in FIG. 9. During operation, the downhole tool 10 aligns itself with the casing 16 longitudinal axis.

FIG. 9 further depicts two spaced exterior annular braces 141 and 142 in the distal and proximal positions, respectively, and preferably formed as magnet structures. A pair of arms 143 and 144 extend proximally from the distal brace 141. A pin 145 represents a pivot joint for each of the arms 143 and 144 with respect to the distal brace 141. A similar structure comprising arms 146 and 147 attaches to pivot with respect to the proximal brace 142 by pins, such as a pin 148 shown with respect to arm 146. The arms 146 and 147 extend distally with respect to the proximal brace 142. Correspondingly radially positioned arms, such as arms 143 and 146, overlap and are pinned. In FIG. 9 a pin 149 connects the end portions of the arms 143 and 146; a pin 150, the arms 144 and 147. In this particular embodiment the arms 146 and 147 are longer than the corresponding arms 143 and 144.

With this construction the arms pivot radially outward when the braces 141 and 142 move toward each other. The respective aim lengths assure that the ends of the arms 146 and 147 engage the inner surface 151 of the wellbore casing 16 before the braces 141 and 142 come into contact. When the braces 141 and 142 move apart, the arms collapse or retract toward the reduced diameter section 102*a* and release from the wellbore casing 16.

FIG. 9 depicts two sets of arms spanning the space between the braces 141 and 142. It will be apparent that more than two sets of arms can span the braces. In a preferred embodiment, three sets of arms are utilized to assure centering of the tool 10 in the casing 16. In accordance with one embodiment of this invention, a reversible motor 152 controls a drive screw 153 and ball connector 154 that attaches to an annular magnet member 155. The magnet member 155 traverses the interior portion of the tubular body reduced diameter section 102*a*. It is stabilized in that body by conventional mechanisms that are not shown for purposes of clarity. With this construction, actuating the motor 152 produces a translation (movement) of the magnet member 155 proximally or distally with the plane of the magnet member 155 remaining normal to the longitudinal axis of the tool 10. Similarly, a reversible motor 156 actuates a drive screw 157 and, through a ball connection 158, causes a translation of a magnet member 159.

If the braces 141 and 142 are constructed as magnet structures and the reduced diameter portion 102*a* has magnetic permeability, a magnetic coupling will exist between the inner magnet members 155 and 159 and the magnet braces 141 and 142. That is, translation of the magnet member 155 will produce corresponding translation of the magnet brace 141 while translation of the magnet member 159 will produce corresponding translation of the magnet brace 142. This coupling can be constructed in any number of ways. In one such approach, a system of magnetically-coupled rodless cylinders, available under the trade name "Ultran" from Bimba Manufacturing Company provide the magnetic coupling having sufficient strength.

In accordance with another aspect of this invention, a control 160 operates the motors 152 and 156 to displace the braces 141 and 142 either simultaneously or differentially with respect to each other to achieve necessary actions that can produce different results. Two specific tasks are described that establish a characteristic of predictable position. The first is the task that enables the transport mechanisms 42*a* and 42*n* to move the tool along the casing 16 to the left in FIG. 9 or downhole. The second task positions the tool 10 stably within the casing 16 at a working position.

Figure 10:
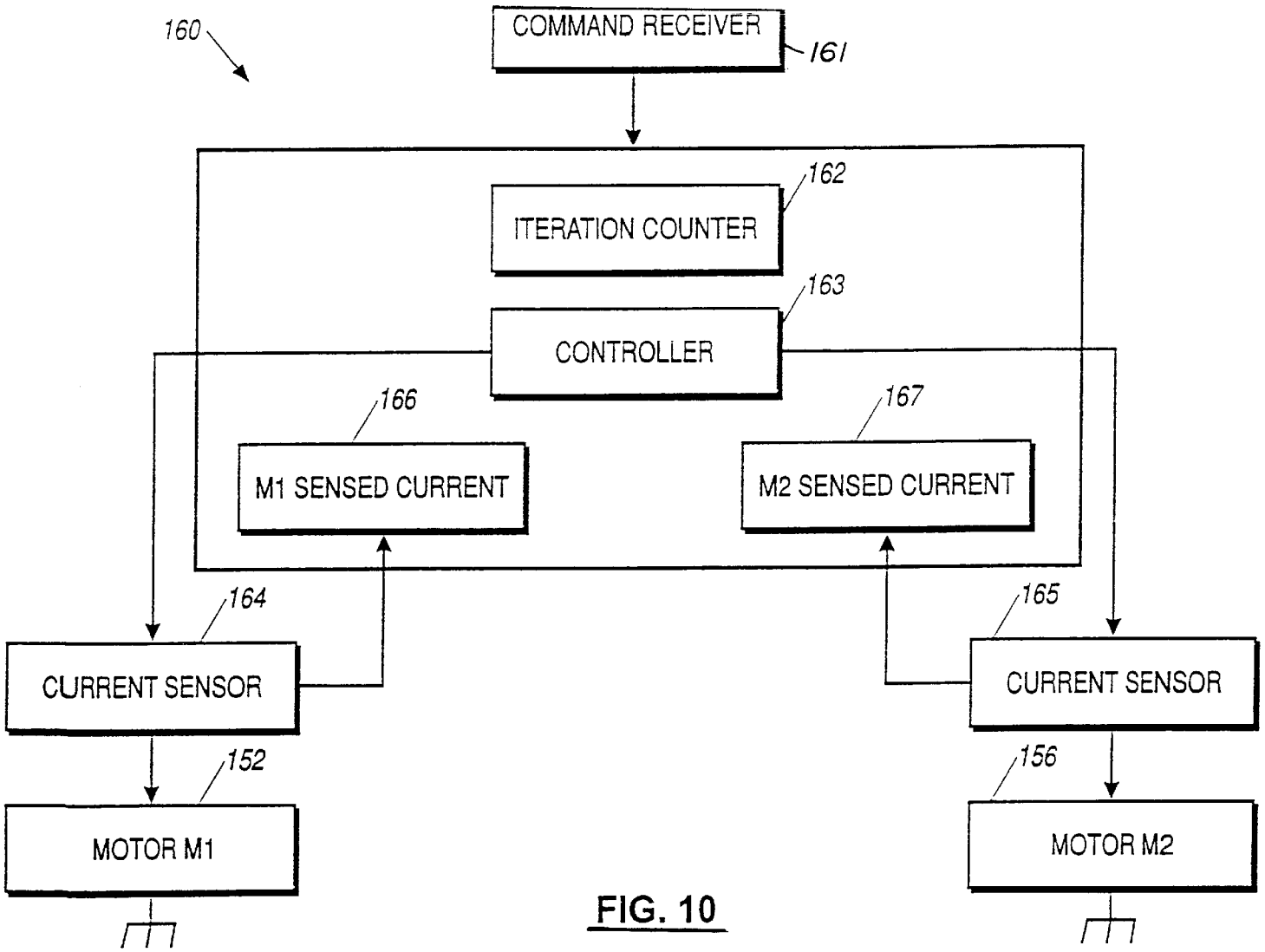
FIG. 10 is a block diagram of basic operations of the operating system useful in connection with the transport mechanism of FIG. 9.

FIG. 10 depicts the organization of the control 160 in terms of modules that can be implemented by registers in a digital computer system. The control 160 includes a command receiver 161 that can respond to a number of high level commands. One command might be: MOVE {direction} {distance}. In a simple implementation, it will generally be known that a complete cycle of operation of the positioning devices such as positioning device 42*n* in FIG. 9 will produce a known incremental translation of the tool along the pipe. The command receiver 161 in FIG. 10 can then produce a number of iterations for an iteration counter 162 that corresponds to the total distance to be traversed divided by that incremental distance. Alternatively, the command itself might contain the total number of iterations (i.e., the total number of incremental distances to be moved).

A controller 163 produces an output current for driving the motors 152 and 156 independently. As will become apparent, one method of providing feedback is to drive the motors to a stall position. Current sensors 164 and 165 provide inputs to M1 sensed current and M2 sensed current registers 166 and 167 to indicate that the current in either of the motors 152 or 156 has exceeded a stall level. There are several well-known devices for providing such an indication of motor stall and are thus described here in detail.

Figure 11:
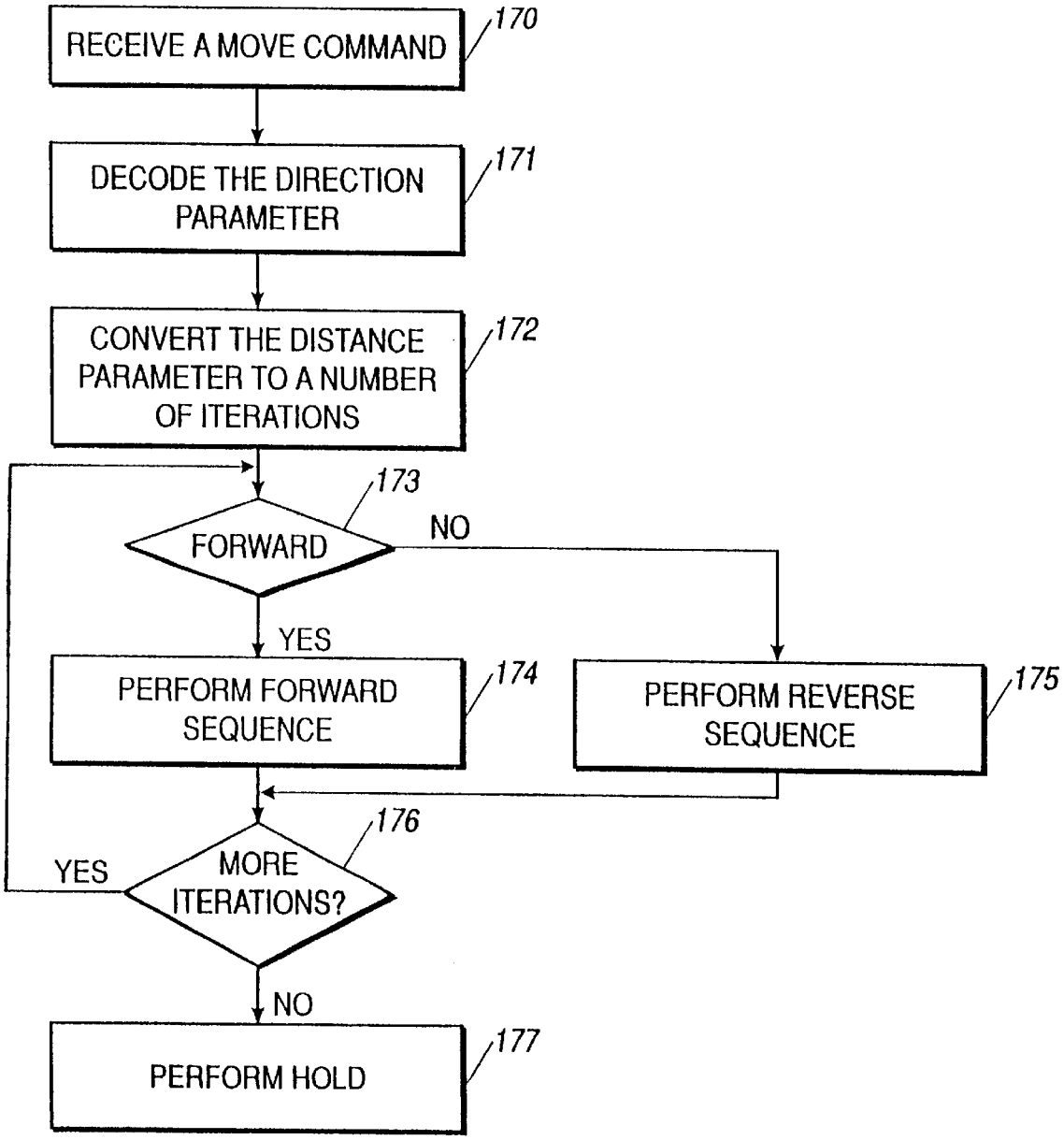
FIG. 11 is a flow diagram of the basic operations of the operating system of FIG. 10.

FIG. 11 depicts a general flow of tasks that can occur in response to the receipt of a move command in step 170 and that, in an artificial intelligence based system, occur in parallel with other tasks. In accordance with this particular task implementation step 171 decodes the direction parameter to determine whether a forward or reverse sequence will be required to move the tool 10 distally or proximally, respectively. In step 172 the system converts the distance parameter to a number of iterations if the command specifies distance in conventional terms, rather than at a number of iterations.

Step 173 branches based upon the decoded value of the direction parameter. If the move command is directing a distal motion or downhole motion, procedure 174 is executed. Procedure 175 causes the transport module 40 to move proximally, that is uphole. Step 176 alters and monitors the value of the iteration counter 162 in FIG. 10 to determine when the transport has been completed. Control branches back to produce another iteration by transferring control back to step 173 while the transport is in process. When all the iterations have been completed, control transfers to step 177 that generates a hold function to maintain the tool at its stable position within the casing 16.

Figure 12:
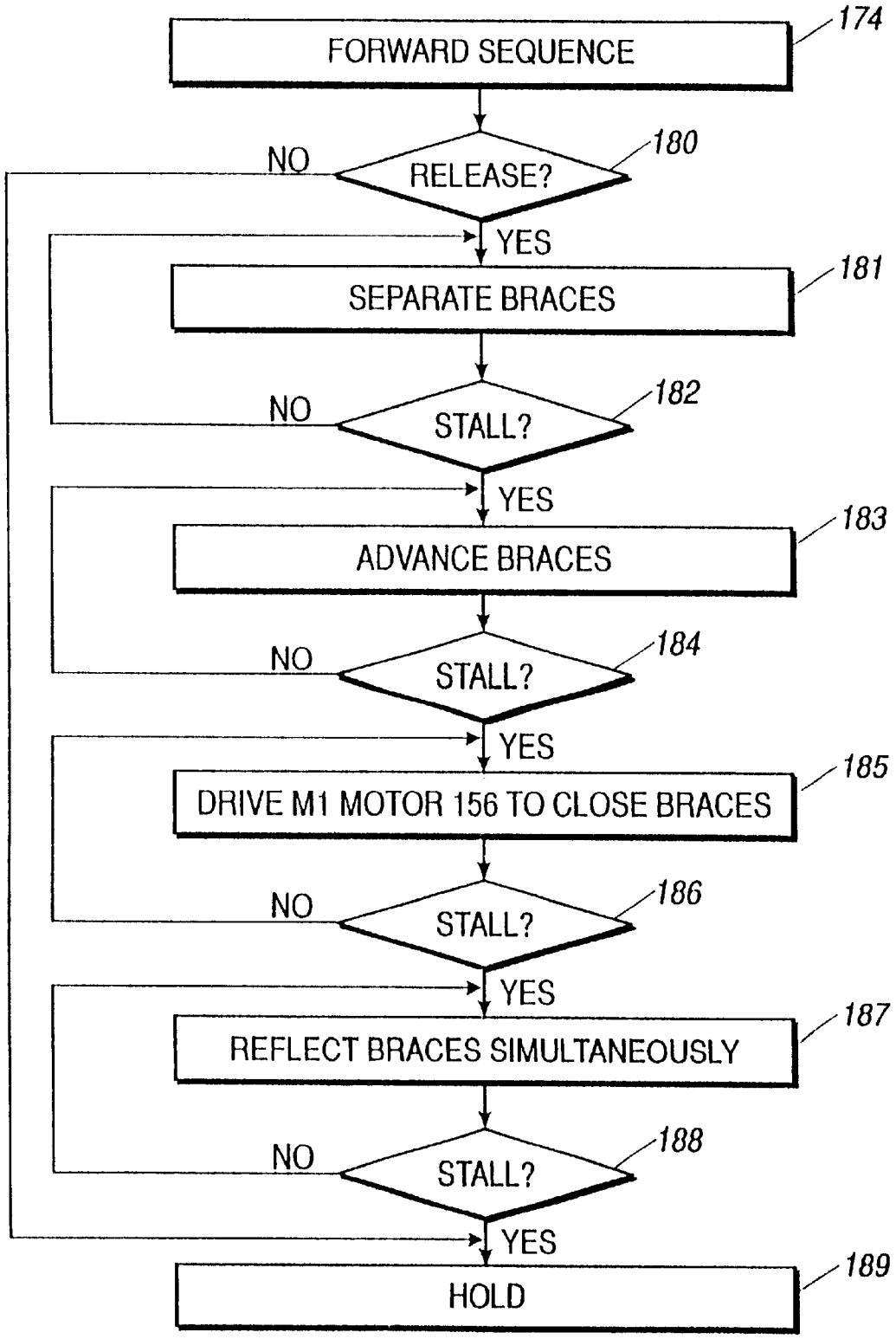
FIG. 12 is a flow diagram of "perform forward sequence" procedure used in the flow diagram of FIG. 11.

When the control operation shown in FIG. 11 requires a forward sequence procedure 174, control passes to a series of tasks shown in FIG. 12. FIG. 12 shows the operation for a single transport mechanism 42*n* shown in FIG. 9. As shown in FIG. 9, to release or retract the arms 146 and 147, step 180 transfers control to step 181 which separates the braces 141 and 142 by translating the distal brace 141 distally and translating the proximal brace 142 proximally. At some point in this process the linkages provided by the arms 143, 144, 146 and 147 will block further separation of the braces 141 and 142. The current as monitored by the current sensors 164 and 165 will rise to a stall level. When this occurs, step 182 transfers control to step 183. Otherwise the control system stays in a loop including steps 181 and 182 to further separate the braces 141 and 142.

In a loop including steps 183 and 184, the controller 163 in FIG. 10 energizes the motors 152 and 156 to move the braces 141 and 142 simultaneously and distally, that is to the left in FIG. 9. When the brace 141 reaches a distal stop, that can be a mechanical stop or merely a limit on the drive screw 153, the current sensors 164 and 165 will again generate a signal indicating a stall condition. Then step 184 transfers control to a step 185 that is in a loop with step 186 to close the braces.

In this particular sequence, step 185 energizes the motor 156 to advance the brace 142 distally causing the arms to move radially outward. The motor 152 remains de-energized, so the brace 141 does not move, even when forces are applied to the brace 141 because there is a large mechanical advantage introduced by the drive screw 153 and ball connection 154 that blocks any motion. When the ends of the arms 146 and 147 engage the casing 16, a stall condition will again exist for the motor 156. The controller 163 in FIG. 10 responds to the stall condition, as sensed by the M2 sensed current register 167, by transferring control to step 187.

The loop including steps 187 and 188 then energizes both the motors 152 and 156 simultaneously to move the braces proximally with respect to the tool. This occurs without changing the spacing between the braces 141 and 142 so the braces maintain a fixed position with respect to the casing 16. Consequently, the autonomous tool moves distally. The loop including steps 187 and 188 continues to move the braces 141 and 142 simultaneously until the braces reach a proximal limit. Now the existence of the stall condition in the motor 156 causes step 188 to transfer control to step 189 that produces a hold operation with the arms in firm contact with the casing 16.

The foregoing description is limited to the operation of a single transport mechanism 42*n*. If the tool includes three-spaced devices that are operated to be 120° out-of-phase with respect to each other, the action of the controller 160 or corresponding controllers for the different transport mechanisms will assure a linear translation of the tool with two of the mechanisms being in contact with the pipe 16 at all times. Consequently the tool remains in the center of the well casing 16 and the advance occurs without slippage with respect to the well casing 16. This assures that the step 172 in FIG. 11 of converting the distance parameter into a number of iterations is an accurate step with predictable positioning even in an open-loop operation. As will be apparent, it is possible that a particular iteration will stop with each of the mechanisms 42*a*–42*n* at a different phase of its operation. On stopping, the sequence shown in FIG. 12 would be modified to produce the hold operation.

The previously mentioned hold operation, as shown in step 177 of FIG. 11, energizes the drive motors 152 and 156 to drive the braces 141 and 142 together. When the arms contact the inside of the casing 16, the motor current will again rise to the stall value and the task will terminate. As will be apparent, this operation could also be performed by moving only one of the motors 152 and 156. Moreover, the mechanical advantage of the drive mechanism assures that the downhole tool 10 remains firmly attached to the casing 16. That is, the transport mechanisms 42*a*–42*n* assure that the downhole tool 10 is positioned with predictability.

FIGS. 9 through 12 depict a construction and operation in which both motors 151 and 156 attach to the transport module 102 to displace their respective braces 141 and 142 independently with respect to the body of the transport module 102. It is also possible to mount one motor, such as motor 152, to the transport module 102 to drive one brace, such as brace 142, relatively to the transport module 102 and mount the other motor, such as motor 156, to the brace 141. In this configuration, the motor 156 drives the brace 142 relative to, or differently with respect to, the brace 141. The changes required to the control to implement such a configuration change are trivial and therefore not discussed.

While the foregoing description defines a movement in terms of a prespecified distance, it is also possible for the movement to be described as movement to a position at which some condition is sensed. For example, if the autonomous downhole tool 10 incorporates a tactile sensor, the command might be to move until the tactile sensor identifies an obstruction or other diameter reduction. To ensure positive traction against the wellbore casing 16 in FIG. 1, the levers 44 should be able to exert a force against the walls at least twice as large as the weight of the tool 10 and force due to the flow of fluids in the wellbore 22. Assuming a neutral force amplification through the levers, the magnetic collars 106 must be able to transfer at least sixty (60) pounds of linear force, which is substantially less than the 300 pounds of force available by utilizing commercially available magnets. With a brace 42*n* having 3.5 inch long arms 146 and 147 and 2.5 inch long short arms 143 and 144, the force amplification for a seven-inch diameter wellbore 22 would be 1.5, while the same bar lengths would produce a force amplification factor in a four-inch wellbore of 0.4. Thus, for a 300 pound linear force, the radial force for the seven-inch diameter would be 450 pounds while that for the four inch bore would be 120 pounds. It should be noted that the numerical values stated above are provided as examples of mechanisms that may be utilized in the mobility platform 40 and are in no way to be construed as any limitations.

End Work Devices—Cutting Device

Figure 3:
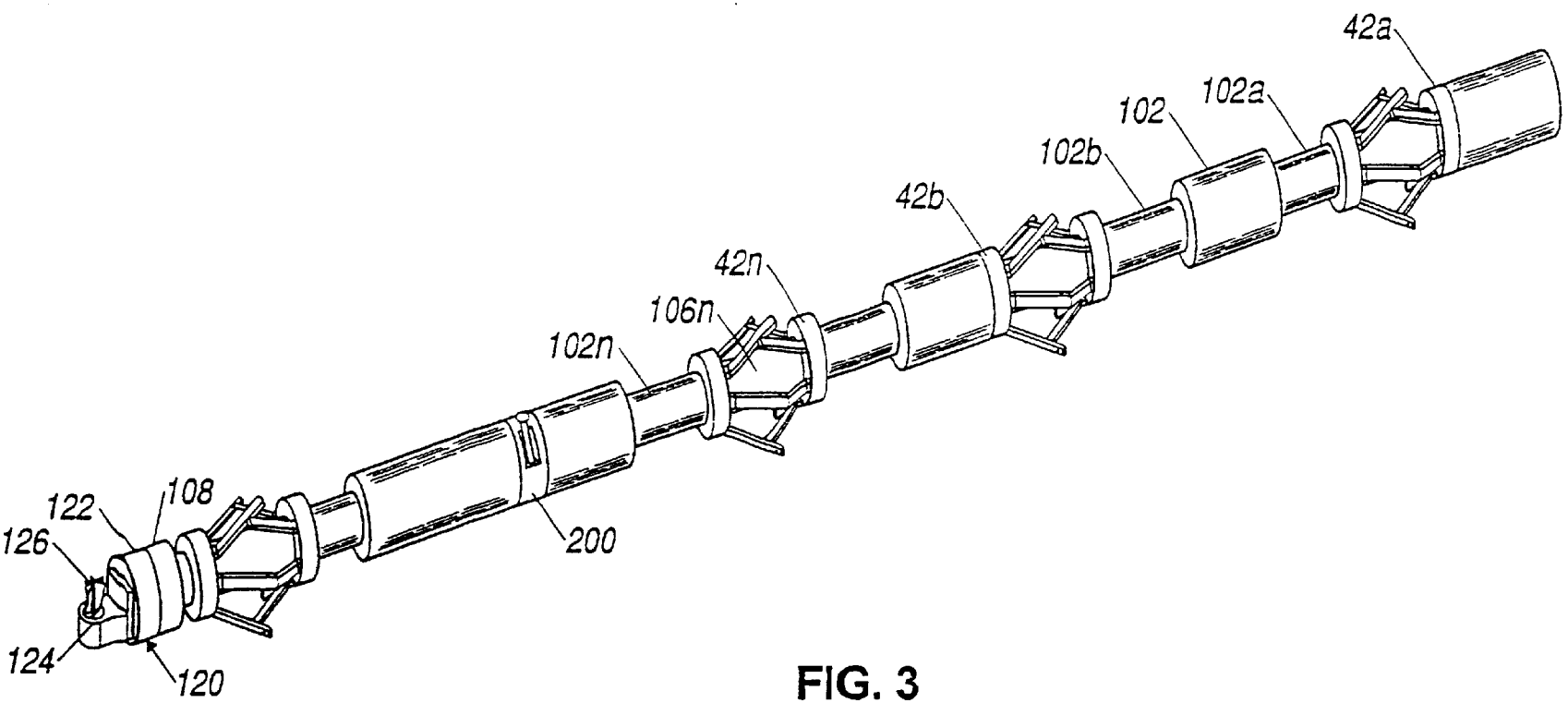
FIG. 3 is an isometric view of an embodiment of a portion of the downhole tool of the present invention that includes a mobility device, a tactile imaging device and an end work device in the form of a cutting device module.

Referring back to FIGS. 1–3, the autonomous downhole tool 10 could include a function module or end work device 30 such as a cutting device 120 at the downhole end of the tool 10. The cutting device 120 can be made as a module that can be rotatably attached to the body 102 at a joint 108. In the embodiment of FIG. 3, the cutting device 120 has a rotatable section 122 which can be controllably rotated about the longitudinal axis of the tool 10, thereby providing a circular motion to the cutting device 120. A suitable cutting element 126 is attached to the rotatable section 122 via a base 124. The base 124 can move radially, i.e., normal to the longitudinal axis of the tool 10, thereby allowing the cutting element 126 to move outwardly radially to the wellbore 22. In addition to the above-described movements or the degrees of freedom of the tool, the cutting device 120 may be designed to move axially independent of the tool body 102, such as by providing a telescopic type action. The rotary motion of the rotatable section 122 and the radial motion of the cutting element 126 are preferably controlled by electric motors (not shown) contained in the cutting device 120. The cutting device 120 can be made to accommodate any suitable cutting element 126. In operation, the cutting element 126 can be positioned at the desired work site in the wellbore 22, such as a location in the casing 14 to cut a window thereat, by a combination of moving the entire tool 10 axially in the wellbore 22, by rotating the base 124 and by outwardly moving the cutting element 126 to contact the casing 16.

To perform a cutting operation, such as cutting a window in the wellbore casing 16, the cutting element 126 like a drill, is rotated at a desired speed, and moved outward to contact the wellbore casing 16. The rotary action of the cutting element 126 cuts the casing 16. The cutting element 126 can be moved in any desired pattern to cut a desired portion of the casing 16. The cutting profile may be stored in the control circuitry contained in the autonomous downhole tool 10, which causes the cutting element 126 to follow the desired cutting profile. To avoid cutting large pieces, which may become difficult to retrieve from the wellbore 22, the cutting element 126 can be moved in a grid pattern or any other desired pattern that will ensure small cuttings. During cutting operations, the required pressure on the cutting element 126 is exerted by moving the base 124 outward. The type of the cutting element 126 defines the dexterity of the window cut by the cutting device 120. The above-described cutting device 120 can cut precise windows in the casing 16. To perform a reaming operation, the cutting element 120 may be oriented to make cuts in the axial direction. The size of the cutting element 126 would define the diameter of the cut.

To perform cutting operations downhole, any suitable cutting device 120 may be utilized in the tool 10, including torch, laser cutting devices, fluid cutting devices and explosives. Additionally, any other suitable end work tools 30 may be utilized in the tool 10, including a workover device, a device adapted to operate a downhole device such as a sliding sleeve or a fluid flow control valve, a device to install and/or remove a downhole device, a testing device(e.g. a sensor) such as to test the chemical and physical properties of formation fluids, temperatures and pressures downhole, etc.

The tool 10 is preferably modular in design, in that selected devices in the tool 10 are made as individual modules that can be interconnected to each other to assemble the tool 10 having a desired configuration. It is preferred to form the image device 32 and end work devices 30 as modules so that they can be placed in any order in the tool 10. Also, it is preferred that each of the end work devices 30 and the image device 32 have independent degrees of freedom so that the tool 10 and any such devices can be positioned, maneuvered and oriented in the wellbore 22 in substantially any desired manner to perform the desired downhole operations. Such configurations will enable a tool 10 made according to the present invention to be positioned adjacent to a work site in a wellbore, image the work site, communicate such images online to the surface, perform the desired work at the work site, and confirm the work performed during a single trip into the wellbore.

In the configuration shown in FIG. 3, the cutting element 126 can cut materials along the wellbore interior, which may include the casing 16 or an area around a junction between the wellbore 22 and a branch wellbore. To cut the casing 16, the cutting element 126 is positioned at a desired location. In applications where the material to be cut is below the cutting tool 120, the cutting element 126 may be designed with a configuration that is suitable for such applications.

End Work Device—Imaging Device

Figure 4:
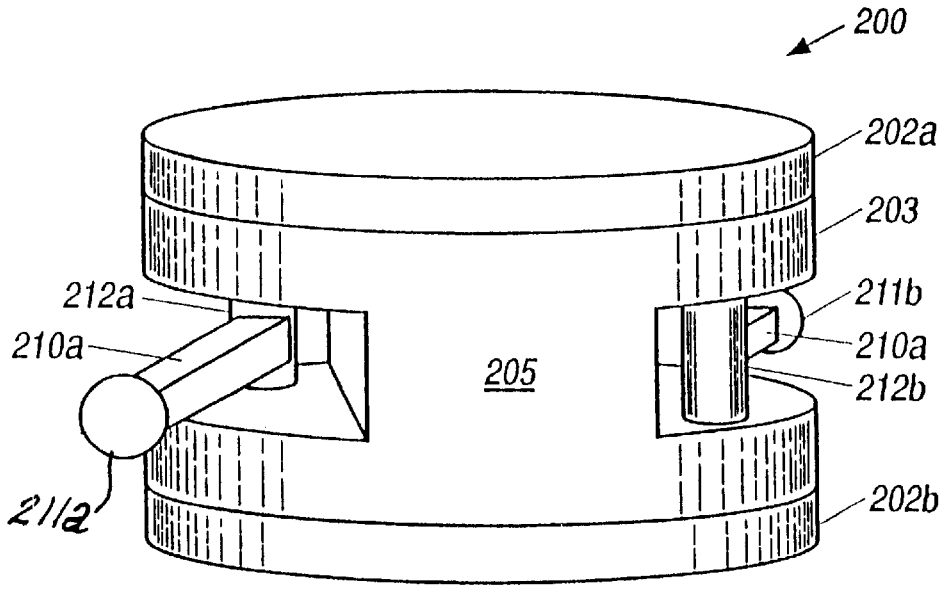
FIG. 4 is an exploded isometric view of the tactile imaging device shown in FIG. 3.
Figure 5:
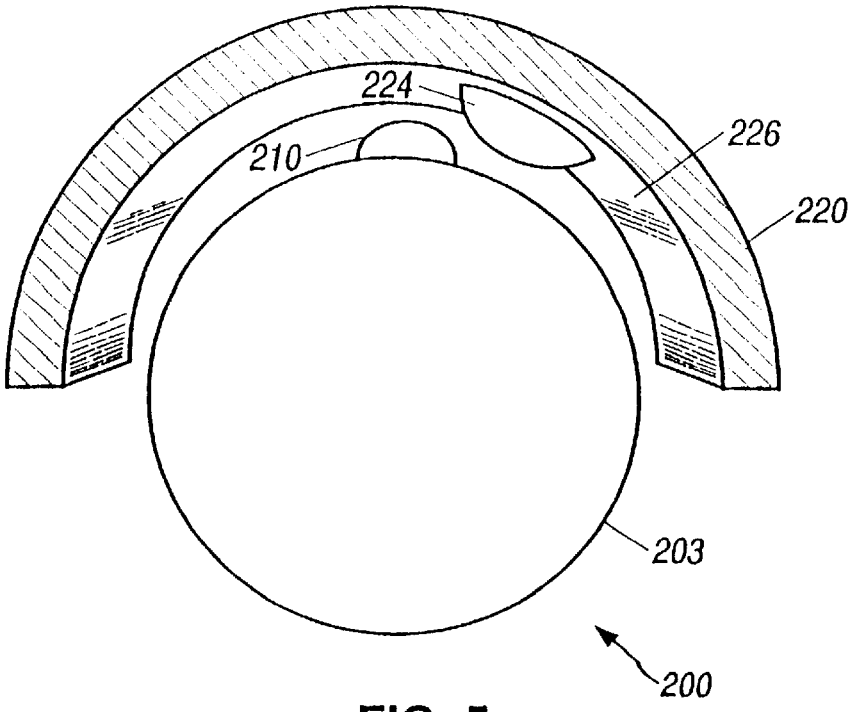
FIG. 5 is an isometric view showing the tactile imaging device of FIG. 4 disposed in a section of pipe having an obstruction at its inside.

As noted-above, the tool 10 may utilize an imaging device to provide an image of the desired work site. For the purpose of this invention any suitable imaging device may be utilized. As noted-earlier, a tactile imaging device is preferred for use with cutting devices as the end work device 30. FIG. 3 illustrates a side-look tactile imaging device 200 according to the present invention carried by the tool 10. FIG. 4 is an isometric view of the tactile imaging device 200. FIG. 5 shows the tactile imaging device 200 placed in a cut-away tubular member 220 having an internal obstruction. Referring to FIGS. 3–5, the imaging device 200 has a rotatable tubular section 203 between two fixed segments 202*a* and 202*b*.

The imaging device 200 is held in place at a suitable location in the tool 10 by the fixed segments 202*a* and 202*b*. The rotating section 203 preferably has two cavities 212*a* and 212*b* at its outer or peripheral surface 205. The cavities 212*a* and 212*b* respectively house their corresponding imaging probes 210*a* and 212*b*. In the filly retracted positions, the probes 210*a* and 210*b* lie in their respective cavities 212*a* and 212*b*. In operations, the probes 210*a* and 210*b* extend outward, as shown in FIG. 4. Each probe 210*a* and 210*b* is spring biased, which ensures that the probes 210*a*–210*b* will extend outward until they are fully extended or are stopped by an obstruction in the wellbore 22. FIG. 5 shows a view of the imaging device 200 placed inside a section of a hollow tubular member 220. The tubular member 220 has an obstruction 224.

In operation, the rotatable section 203 which carries the probes 210*a*–210*b* is continuously rotated at a known speed (rpm). The outwardly extended probes 210*a* and 210*b* follow the contour of the containing boundary. The probes 210*a*–210*b* are passive devices which utilize springs to force them against a mechanical stop. The position of the probes 210*a*–210*b* are measured by measuring the angle of rotation of the probes pivot point at the section 203. This angle in conjunction with the angle of rotation of the sub-assembly relative to the rest of the tool 10 and the known diameter of the device 200 and the length of the probes 210 are sufficient to perform a real-time inverse kinematic calculation of the endpoints 211*a* and 211*b* of the probes 210*a* and 210*b*. By associating this end point location with the tool's current depth, a string of three dimensional data points is created which creates a spiral of data in the direction of the movement of the tool 10 representing wall location. This data is converted into three dimensional maps or pictures of the imaging device environment by utilizing programs stored in the tool 10 or the surface control unit 70. The resolution of the maps is determined by the rate of travel of the tool. By varying the rotational speed of the probes 210*a*–210*b* and the data acquisition rate per revolution, the resolution can be adjusted to provide usable three dimensional maps of the wellbore interior.

The three dimensional images can be displayed on the display 72 where a user or operator can, rotate and manipulate the images in other ways to obtain a relatively accurate quantitative picture and an intuitive representation of the downhole environment. Although only a single probe 210 is sufficient in obtaining three-dimensional pictures, it is preferred that at least two probes, such as probes 210*a*–210*b*, are utilized. Two or more probes enable cross-correlation of the image obtained by each of the probes 210*a*–210*b*.

In the embodiment described above, since the probes 210 are pressed against the wellbore wall, there is a potential for dynamic effects to create blind spots artificially making the objects look larger than they really are. The controller continuously monitors for changes in the probe location which are near the rate at which a freely expanding probe 210 moves. If such a situation occurs, the rotational rate of the probes 210 is reduced and/or the pass is repeated. Also, if a feature is detected, the imaging device 200 preferably alerts the user and if appropriate, the imaging device slows down to make a higher resolution image of the unusual feature.

Figure 6:
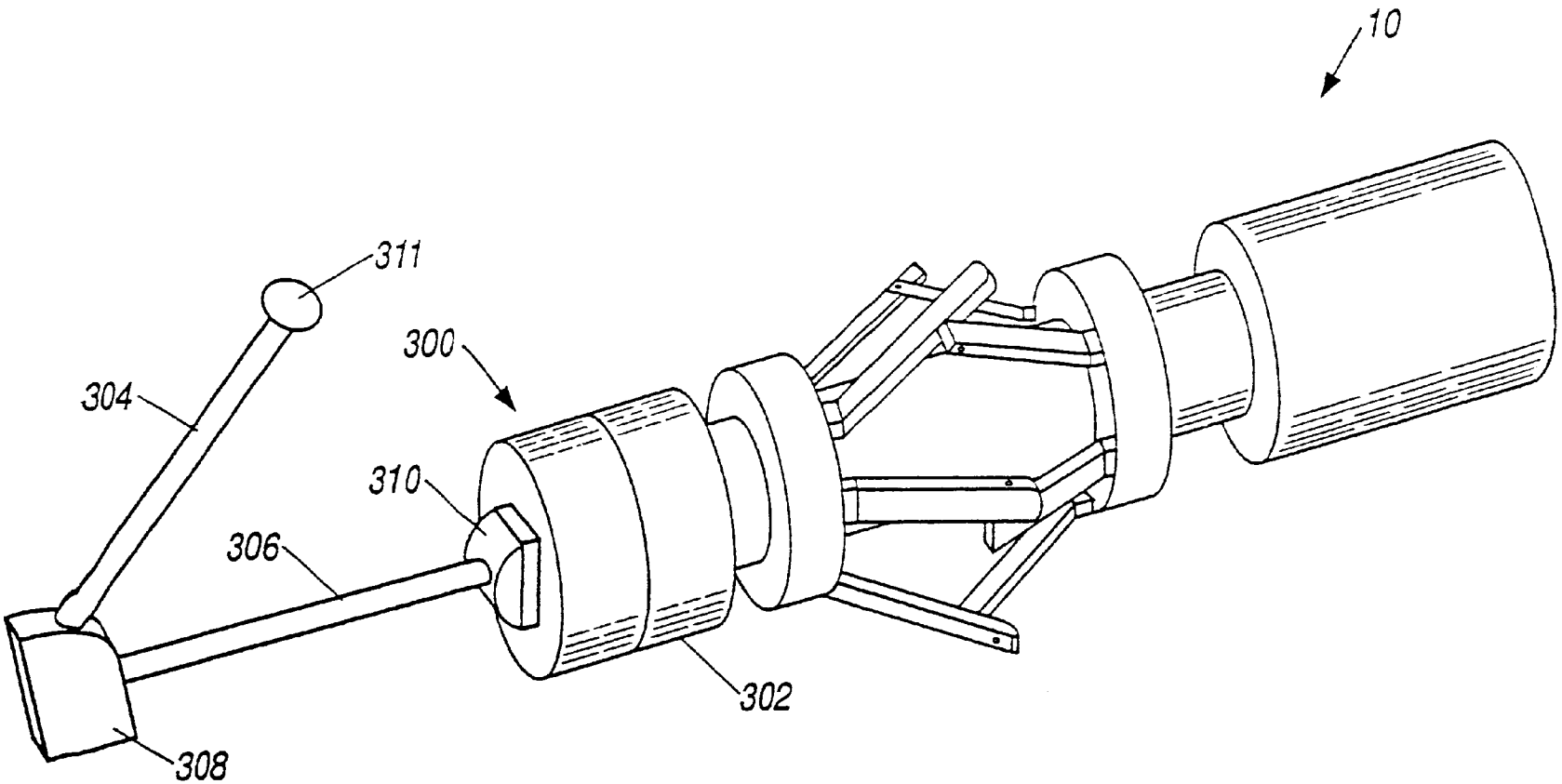
FIG. 6 is an isometric view of an alternative embodiment of a tactile imaging device and a portion of the mobility device shown in FIG. 1.

FIG. 6 shows an embodiment of a tactile imaging device 300 that may be attached to the front end of the autonomous downhole tool 10 (FIG. 1) to image a work site downhole or in front of the tool 10. The device 300 includes a rotating joint 302 rotatable about the longitudinal axis of the tool 10. The probe assembly includes a probe arm 304 and a pivot arm 306, each such arm pivotly joined at a rotary joint 308.

The pivot arm 306 terminates at a probe tip 311. The other end of the pivot arm 306 is attached to the joint 302 via a rotary joint 310. In operation, the device 300 is positioned adjacent to the work site. The rotary joint 302 rotates the probe tip 311 within the wellbore 22. The rotary joint 310 enables the pivot arm 306 to move in a plane along the axis of the tool 10 while the joint 308 allows the probe arm 304 to move about the joint 308 like a forearm attached at an elbow. The linear degree of freedom to the device 300 is provided by the linear motion of the tool 10. The radial movement in the wellbore is provided by the rotation of the joint 302. The joints 308 and 310 provide additional degrees of freedom that enable positioning the probe tip 311 at any location within the wellbore 22. The device 300 is moved within the wellbore 22 and the position of the probe tip 311 is calculated relative to the tool 10 and correlated with the depth of the tool 10 in the wellbore. The position data calculated is utilized to provide an image of the wellbore inside. The probe arm 304 of the device 300 may be extended toward the front of the tool 10 to allow probing an object lying directly in front of the tool 10.

The above-described tool 10 configuration permits utilizing relatively small outside dimensions (diameter) to perform operations in relatively large diameter wellbores 22. This is due to the fact that the length of the levers of the mobile platform, the probes of the tactile image device and the cutting tool extend outwardly from the tool body, which allows maintaining a relatively high ratio between the wellbore internal dimensions and the tool body diameter. Additionally outwardly extending or biased arms or other suitable devices may be utilized on the tool body to cause the tool 10 to pass over branch holes for multi-lateral wellbore operations.

End Work Device—Logging Device

It is often desirable to measure selected wellbore and formation parameters either prior to or after performing an end work. Frequently, such information is obtained by logging the wellbore 22 prior to performing the end work, which typically requires an extra trip downhole. The tool 10 may include one or more logging devices or sensors. For example, a collar locator may be incorporated in the service tool 10 to log the depth of the tool 10 while tripping downhole. Collar locators provide relatively precise measurements of the wellbore depth and can be utilized to correlate depth measurement made from surface instruments, such as wheel type devices. The collar locator depth measurements can be utilized to position and locate the imaging and end work devices 30 of the tool 100 in the wellbore. Also, casing inspection devices, such as eddy current devices or magnetic devices may be utilized to determine the condition of the casing, such as pits and cracks. Similarly, a device to determine the cement bond between the casing and the formation may be incorporated to obtain a cement bond log during tripping downhole. Information about the cement bond quality and the casing condition are especially useful for wellbores 22 which have been in production for a relatively long time period or wells which produce high amounts of sour crude oil or gas. Additionally, resistivity measurement devices may be utilized to determine the presence of water in the wellbore or to obtain a log of the formation resistivity. Similarly gamma ray devices may be utilized to measure background radiation. Other formation evaluation sensors may also be utilized to provide corresponding logs while tripping into or out of the wellbore.

End Work Device—Detachable Device

Figure 7:
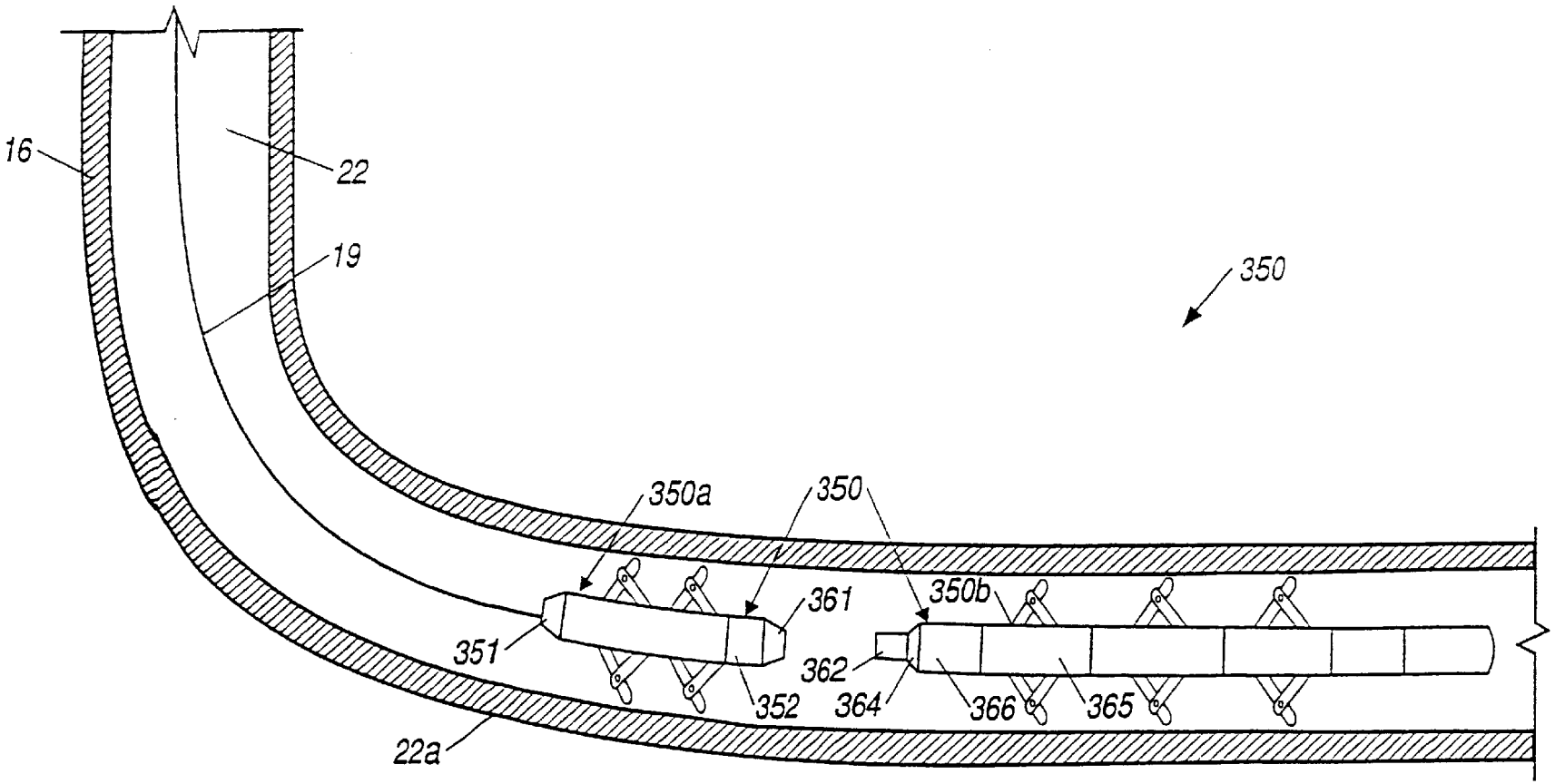
FIG. 7 is a schematic showing an alternative embodiment of a downhole tool according to the present invention deployed in a wellbore for use in the system of FIG. 1.

In extended reach wellbores, the use of a wireline may require a mobility platform to generate excessive force as the depth increases due to the increased length of the wireline that must be pulled by the platform. In a production wellbore, it may be desirable to deploy untethered tools to service wellbore areas where the tethered wireline may impede the mobility of the platform. FIG. 7 shows a downhole tool 350 made after the schematic of FIG. 2B that may be utilized to traverse the wellbore to perform downhole operations without a tethered wireline. The tool 350 is composed of two units: a base unit 350*a* attached to the wireline 19 at its uphole end 351 and having a downhole connector 361 at its downhole end 352; and a battery-powered mobile unit 350*b*.

The mobile unit 350*a* includes the mobile platform and the end work device and may include an imaging device and any other desired device that is required to perform the desired downhole operations as explained earlier with respect to the tool 10 (FIG. 1). The mobile unit 350*b* also preferably includes all the electronics, data gathering and processing circuits and computer programs (generally denoted by numeral 365) required to perform operations downhole without the aid of surface control unit 70. A suitable telemetry system may also be utilized in the base unit 350*a* and the mobile unit 350*b* to communicate command signals and data between the units 350*a* and 350*b*. The mobile unit 350*b* terminates at its uphole end 364 with a matching detachable connector 362. The mobile unit 350*b* is designed so that upon command or in response to programmed instructions associated therewith, it can cause the connector 362 to detach it from the connector 361 and travel to the desired work site in the wellbore 22 to perform the intended operations.

To operate the tool 350 downhole, the tool units 350*a* and 350*b* are connected at the surface. The tool 350 is then conveyed into the wellbore 22 to a suitable location 22*a* by a suitable means, such as a wireline or coiled tubing 19. The conveying means 24 is adapted to provide electric power to the base unit 350*a* and contains data communication links for transporting data and signals between the tool 350 and the surface control unit 70. Upon command from the surface control unit 70 or according to programmed instructions stored in the tool 350, the mobile unit 350*b* detaches itself from the base unit 350*a* and travels downhole to the desired work site and performs the intended operations. Such a mobile unit 350*b* is useful for performing periodic maintenance operations such as cleaning operations, testing operations, data gathering operations with sensors deployed in the mobile unit 350*b*, gathering data from sensors installed in the wellbore 22 or for operating devices such as a fluid control valve or a sliding sleeve. After the mobile unit 350*b* has performed the intended operations, it returns to the base unit 350*a* and attaches itself to the base unit 350*a* via the connectors 361 and 362. The mobile unit 350*b* includes rechargeable batteries 366 which can be recharged by the power supplied to the base unit 350*a* from the surface via the conveying means 24.

Functional Description

The general operation of the above described tools is described by way of an example of a functional block diagram for use with the system of FIG. 1. Such methods and operations are equally applicable to the other downhole service tools made according to the present invention. Such operations will now be described while referring to FIG. 8, which is a block diagram of the functional operations of the system 100 (see FIG. 1).

Figure 8:
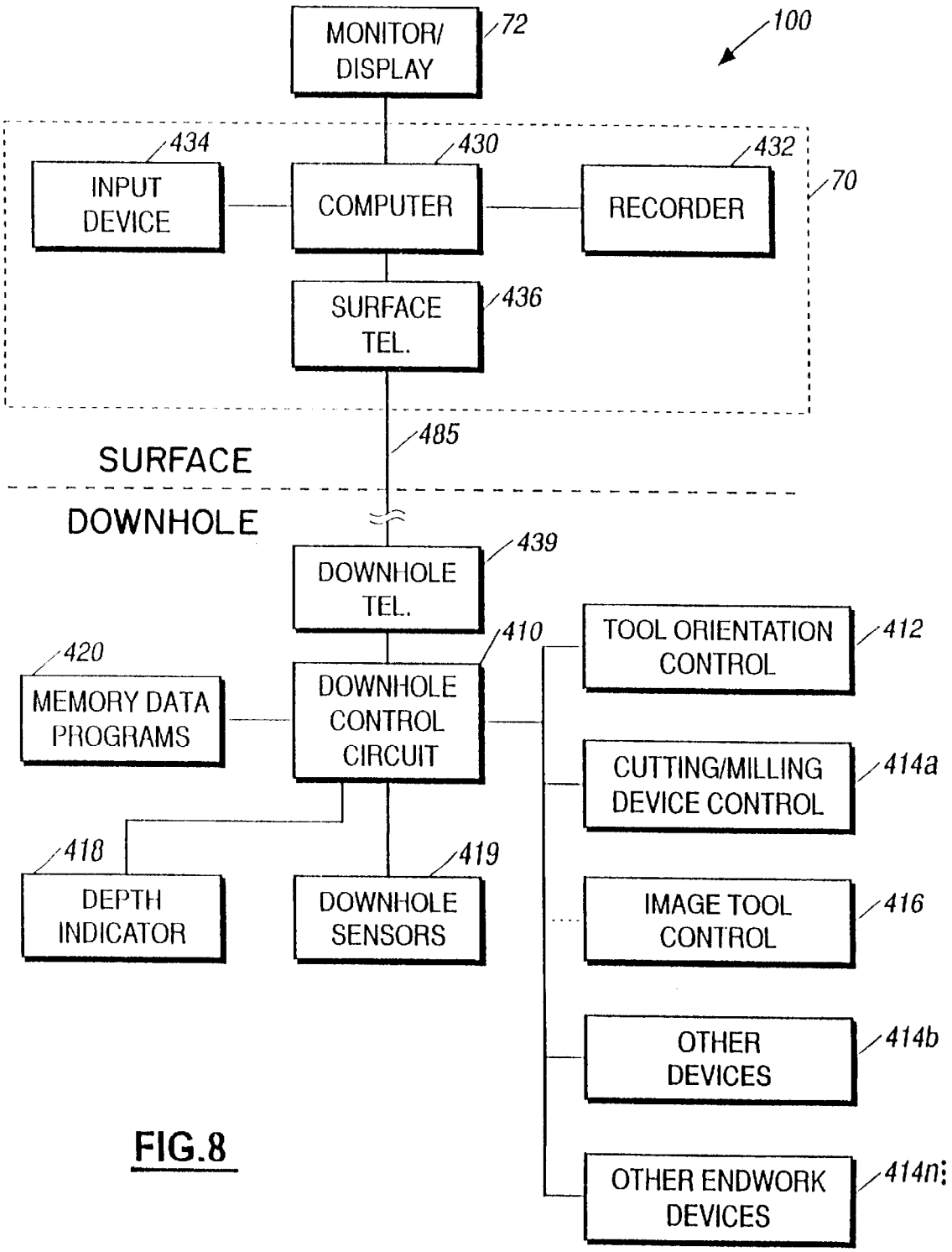
FIG. 8 shows a functional block diagram relating to the operation of the system of FIG. 1.

Referring to FIG. 8, the downhole tool 10 preferably includes one or more microprocessor-based downhole control circuit or module 410 using artificial intelligence. The control module 410 determines the position and orientation of the tool 10 shown as a task box 412. The control circuit 410 controls the position and orientation of the cutting element 30 (FIG. 1) as a task box 414. Similarly, the control module 410 may control any other end work devices, generally designated herein by boxes 114*b–n*. During operations, the control module 410 receives information from other downhole devices and sensors, such as a depth indicator 418 and orientation devices, such as accelerometers and gyroscopes. The control circuit 410 may communicate with the surface control unit 70 via the downhole telemetry 439 and via a data or communication link 485. The control circuit 410 preferably controls the operation of the downhole devices. The downhole control circuit 410 includes memory 420 for storing data and programmed instructions therein. The surface control unit 70 preferably includes a computer 430, which manipulates data, a recorder 432 for recording images and other data and an input device 434, such as a keyboard or a touch screen for inputting instructions and for displaying information on the monitor 72. As noted earlier, the surface control unit 70 and the downhole tool 10 communicate with each other via a suitable two-way telemetry system.

Artificial Intelligence Based Control Unit

Figure 13:
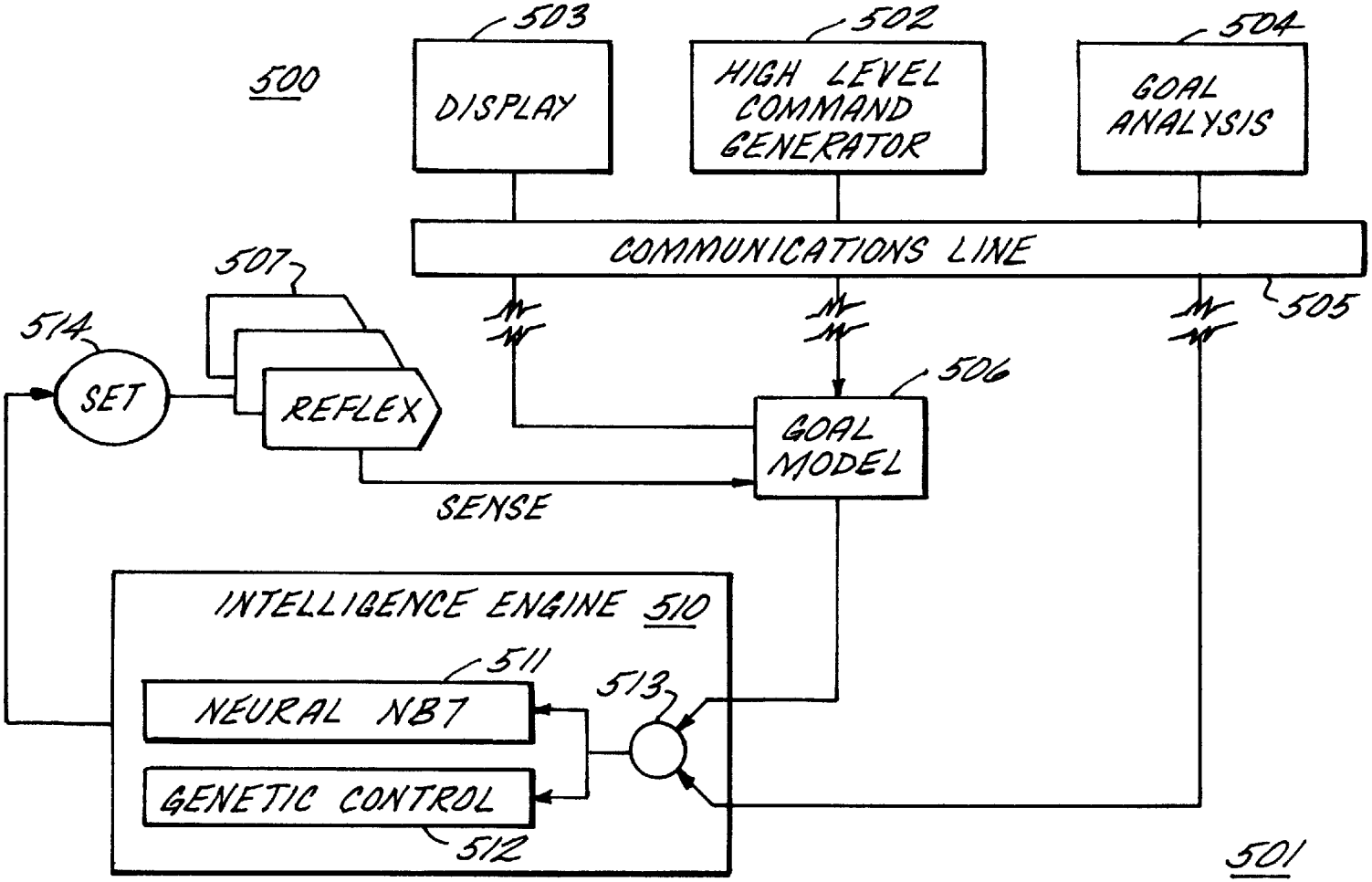
FIG. 13 is a general block diagram that depicts a control module used in the functional block diagrams of FIGS. 2A and 2B.

FIG. 13 demonstrates a general configuration of a control unit can be incorporated in each of the foregoing systems such as in the control module 21 in FIG. 2A.

The system has two physically separated portions namely a wellhead location 500 and a downhole location 501. At the wellhead location 500, a high level command generator 502 gives commands like the foregoing MOVE {direction} {distance}. An optional display 503 provides information to supervisory personnel concerning critical parameters. This presentation will be in some meaningful form but, as will become apparent, can be based upon cryptic messages received from the downhole position location 501. An optional goal analysis circuit 504 allows an operator to modify the operation of downhole as will be described. A communications link 505 will include a transceiver at the wellhead location 500 and a transceiver at the downhole 501. Conventional wellbore communications operate at low bandwidths. The use of artificial intelligence at the downhole location 501 enables the transfer of high level commands that require a minimal bandwidth. Likewise, the use of cryptic messages for transfer from the downhole location 501 to the wellhead location 500 facilitate the transfer of pertinent information.

At the downhole location 501, a goal model 506 associated with each artificial intelligence based control unit receives each command and input signals from certain monitoring devices 507 designated as REFLEXES that produce SENSE inputs. The REFLEXES 507 also include actuating devices such as the motors 152 and 156 in the transport module embodiment of FIG. 9.

An intelligence engine 510 incorporates one or more elements shown within the box including a neural element 511 and a genetic control 512. These mechanisms are capable of learning and adapting to changing conditions in response to inputs that condition the neural net 511 and genetic control 512. The goal model 506 generates these signals although the optional analysis input 504 can provide other conditioning inputs. The intelligence engine 510 manages the inputs for controlling set points through a set element 514 for certain of the REFLEXES 507. As previously indicated each of the REFLEX devices 507 manages a particular aspect in the physical environment and one or more may contain sensors that pertain to some particular phenomena that are coupled to the goal model 506 as the SENSE signals. The goal model 506 represents the current desired state of the overall system. SENSE values that differ from the current goal model can be presented to supervisory personnel at the wellhead location 500 by means of the display 503. The supervisory personnel can then elect to reinforce or modify the resulting behavior.

In a specific implementation, the control at the downhole location 501 can be incorporated in one or more microprocessors. The intelligence engine 510 will include one or more processes executing algorithms of either the neural network or genetic type with an optional suitable randomizing capability. Such elements are readily implemented in a real-time version of a commercially available programming language. The intelligence engine 510 may contain one or more processors depending upon the complexity of the control system and the time responses required. More specifically the intelligence engine 510 can be configured to control such things as the task shown in FIGS. 10 through 12 and still further tasks as may be required by a particular device.

In whatever specific form the control module shown in FIG. 13 may take, a goal model 506 or equivalent element receives a command and compares the goals established by that command with the inputs from various ones of the REFLEXES 507. The current sensors 164 and 165, for example, provides such inputs in the embodiment shown in FIGS. 9 through 12. The goal model 506 then transfers information to the intelligence engine 510 that conditions the neural net 511 and genetic control 512 to produce set points through the set element 514 and other of the REFLEXES such as those that provide outputs to the motors 152 and 156. Thus in normal operations the neural net 511 and genetic control 512 cooperatively act to provide a series of set points at the set element 514 that are routed to appropriate REFLEXES 507 to bring the state of the element under control into compliance to the established goal. As is also known in the art, failure to meet the goal within predetermined parameters can produce error signals that may result in communications with the wellhead location 500 for manual override or the like.

For example, the operation defined in FIGS. 10 through 12 assumes no obstructions will be found as the module 100 transfers through the wellbore. However, the process can be modified so that each of the stall condition tests can be augmented for a given state of operation or in response to other different sensors to determine whether the stall results from another condition such as encountering an obstruction. Alternatively if a tactile or other sensor identifies an obstruction, then control system can utilize that information to define an alternative strategy to avoid or compensate for the obstruction.

The foregoing embodiments disclose a transport module and a plurality of work devices that each have control modules incorporating artificial intelligence. It will be apparent if two such elements exist in a particular system, an additional communication link will exist between the downhole location 501 shown in FIG. 13 and a corresponding structure that may be attached to the other element. This can provide communications to the wellhead location 500 for both tools independently. In some situations where the end work device is always physically connected to the transport device the communications may be inherent. If the end work device can detach from the transport module then an alternative link will be established.

Second Transport Module

Figure 14:
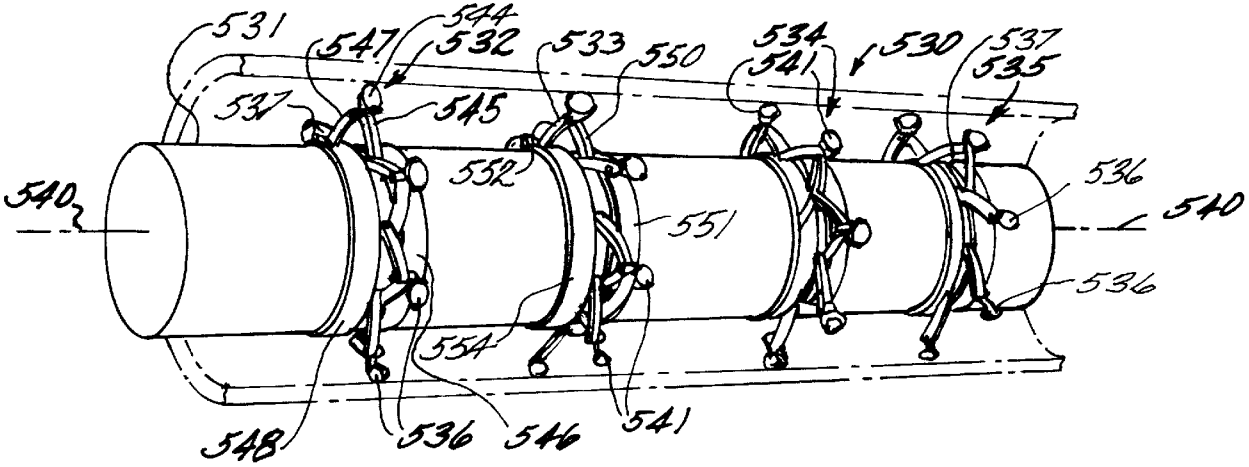
FIG. 14 is a view of an alternative embodiment of a transport mechanism.
Figure 15:
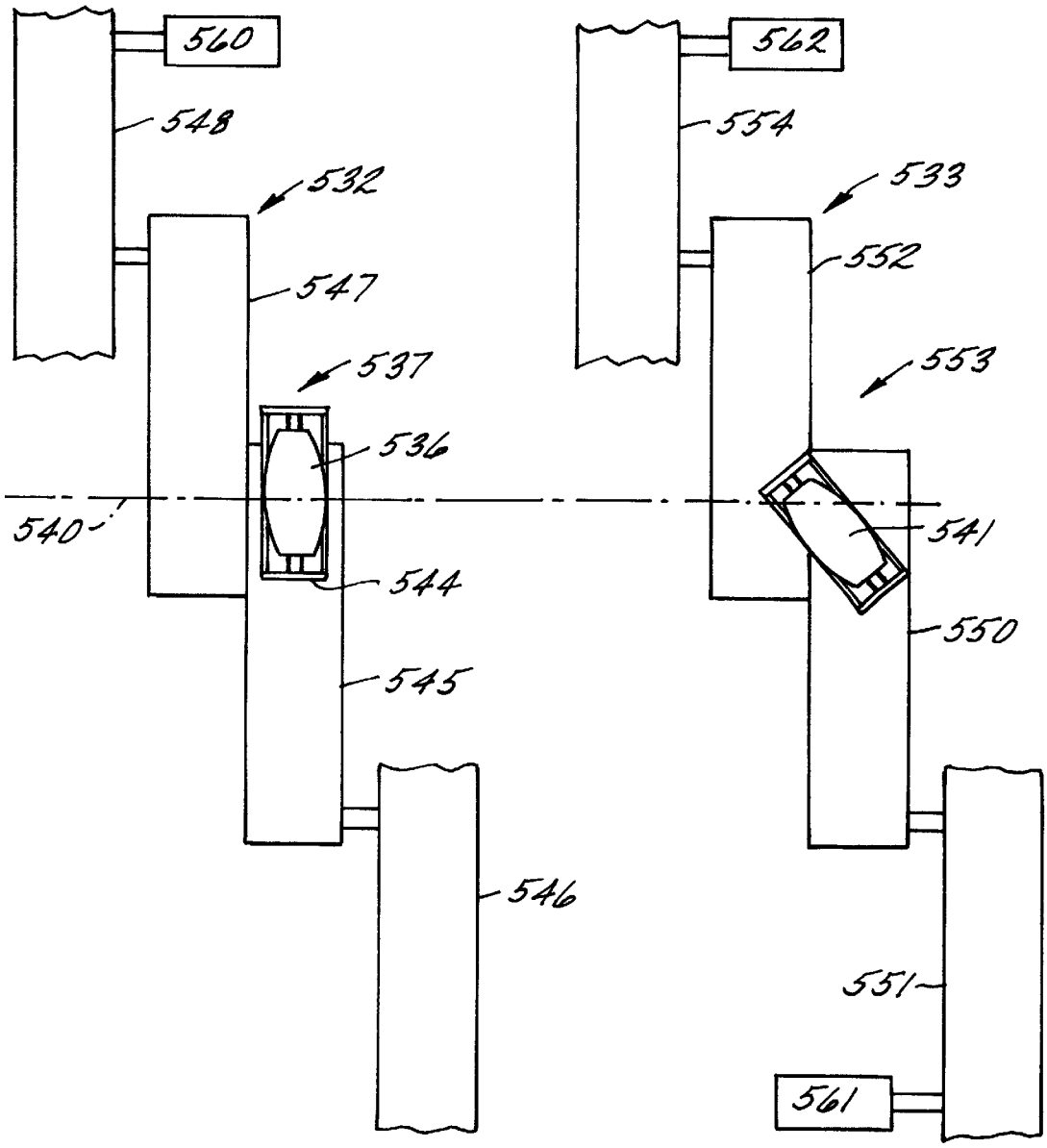
FIG. 15 is a more detailed view of portions of the transport mechanism shown in FIG. 14.

FIGS. 14 and 15 depict another transport module that is an alternative to the transport module shown in FIGS. 8 and 9. This transport module is a rotating brace unit 530 that includes a cylindrical body 531. As set of rings 532, 533, 534 and 535 are axially spaced along the cylindrical body 531. The rings 532 and 535 perform a centering function; the rings 533 and 535, a displacement function. Although these functions are alternated along the specific embodiment of the cylindrical body 531 as shown in FIG. 14, it will be apparent that other arrangements, such as including the rings 532 and 534 at the ends and the rings 533 and 535 in the center could also be used.

Each of the centering rings 532 and 534 includes a plurality of equiangularly spaced rollers 536 that rotate about axes that are transverse to an axis 540 and are supported at the end of a scissors mechanism 537. Each of the rings 533 and 535 include a plurality of rollers 541 that lie on rotational axes that are skewed by some angle to the axis 540, for example 45°. More specifically, and as more particularly shown in FIG. 15, each roller 536 is carried in a yoke 544 on one arm 545 of the scissors mechanism 537. The arm 545 pivotally attaches to a fixed ring 546. A second arm 547 of each scissors mechanism 537 attaches to a second ring 548 that is rotatable with respect to the transport module 530 and particularly with respect to the ring 546. Rotation of the ring 548 moves the arm toward the arm 545 to displace the yoke 544 and roller 536 radially outward into rolling contact with the interior of the wellbore. When each of the centering mechanisms 232 and 235 are expanded into contact, the transfer module 530 will move along a pipe without rotation relative to a wellbore casing.

Referring specifically to the driving ring 533, an arm 550 pivotally attaches to a ring 551. Another arm 552 forms the scissors mechanism 553 and pivotally attaches to a ring 554. In the driving mechanism 533 the rings 551 and 554 are both rotatable with respect to the module 530 and with respect to each other. Moving the ring 554 relative to the ring 551 displaces the roller 541 and its yoke radially outward into contact with the surface of the well casing. Once in that position, concurrent rotation of the rings 551 and 554 tend to move the roller 541 along a helical path. However, as the rollers 536 constrain any rotation of the module 530, the rotation of the rollers 541 displaces the transport module 530 longitudinally in the wellbore casing. In the configuration of FIG. 15, rotation toward the bottom of FIG. 15 produces a displacement to the left; upward rotation, displacement to the right.

A variety of mechanisms can be used for driving the rings 548, 551 and 554. FIG. 15 schematically depicts a motor drive 560 for driving the ring 548 and motor drives 561 and 562 for driving the rings 551 and 554 respectively. In one embodiment each of these motors can be mounted to the cylindrical body of the cylindrical body 531 and controlled independently. In an alternative embodiment, the drive motor 562 might attach to the ring 551 to produce differential rotation between the rings 551 and 554 while another drive unit 561 would then produce the simultaneous rotation. Each approach has known advantages and disadvantages and can be optimized for a particular application.

Still another alternative for rotating the rings 548, 554 and 551 can be used if it desired that the cylindrical body 531 shown in FIG. 14 comprise an open cylinder. Each of the rings 548, 551 and 554 then constitute an outer portion of an harmonic gear drive that will enable internal cams to produce the necessary rotation as known in the art.

As in the embodiment of FIGS. 9 through 12, the control, having the general form of the control shown in FIG. 13, will monitor a number of inputs including motor current to identify the pressure being exerted on the walls, ring revolutions to identify the displacement of the module 530 along the wellbore casing and rotational speed and direction to identify the velocity of the module 530. Other sensors and actuators, not shown, will monitor the entire state of the transport module 530 to enable a control such as shown in FIG. 13 to appropriately actuate and operate the various elements in the transport module 530.

Tether Management Unit

Figure 16:
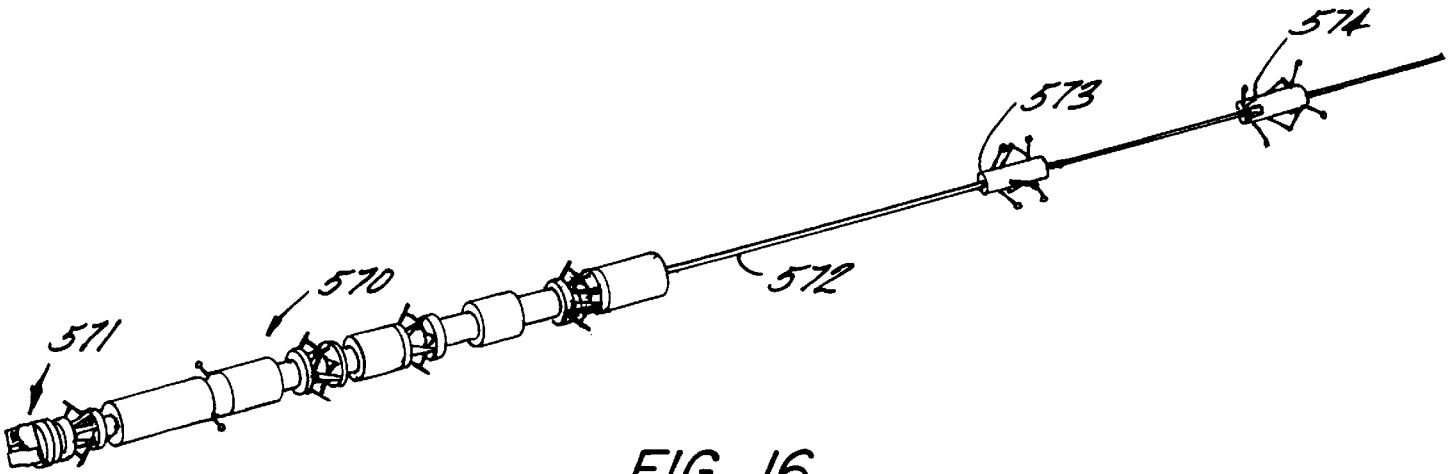
FIG. 16 is a view of a tether management system constructed in accordance with another aspect of this invention.
Figure 17:
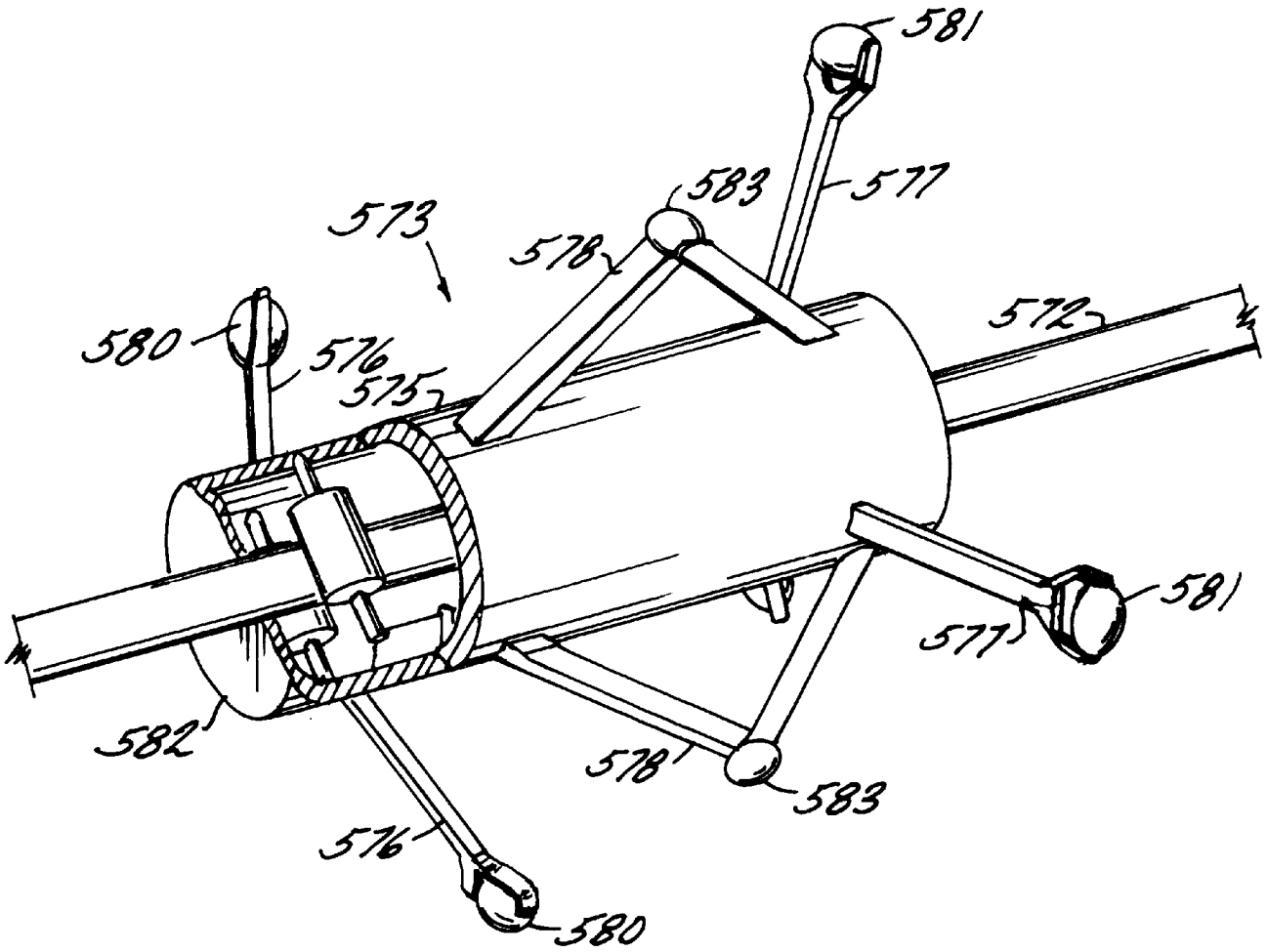
FIG. 17 is an enlarged view of a tether management module used in the system shown in FIG. 16.

When a device drags a tether into a well for a sufficient distance, a resulting strain can increase beyond the breaking strength of the tether as friction builds by virtue of the medium through which the tether is being pulled and often by virtue of additional friction caused if the tether passes through various bends. FIGS. 16 and 17 depict a device that is useful in reducing the strain on the tether and thereby minimizing the possibility of breakage. More particularly FIG. 16 depicts a transport module 570 and end work device 571 at the end of a tether 572. Two tether management devices 573 and 574, constructed in accordance with this invention, are positioned at spaced locations along the wire 572.

FIG. 17 depicts the tether management module 573 in more detail. Such devices commonly called "tugs" include a main body 575. The body will contain, in a preferred embodiment, a control system according to the general configuration of FIG. 13. The main body 575 in FIG. 17 supports three expandable mechanisms, all shown in an expanded position. These include centering arm mechanisms 576 and 577 and a locating arm mechanism 578. The centering arm mechanisms 576 and 577 support rollers 580 and 581, respectively, in yokes at their terminations. The rollers rotate on axes that are transverse to the axis of the tether 572. Consequently these rollers 580 and 581 facilitate a transport of the device along the wellbore casing without rotation.

An internally driven roller mechanism 582 can selectively engage the tether 572. When engaged, the roller mechanism produces a relative displacement between the tether management module 573 and the tether 572 as described later. The associated control system monitors various conditions including the tension on the tether 572 and the positions of the various elements to establish several operating modes. One or more of these modes might be selected in a particular sequence of operations.

The body 575 and internal mechanisms can also be constructed to be a unitary structure in which the end of the tether 572 passes. An alternate clam shell or like configuration can allow the module 573 to be attached at an intermediate portion of the tether 572.

In one operation mode, the roller mechanism 582 is held in a stationary position by corresponding driving means and the arms 576, 577 and 578 are all retracted. This could be used, for example, where a device module 573 is attached immediately adjacent the transport module 571 in FIG. 16 to be carried adjacent to the module 571 until it was to be deployed.

In another mode of operation, all arm mechanisms 576, 577 and 578 can be extended to fix the module 573 with respect to the wellbore casing. If driving mechanism for the roller mechanism 582 allows the roller mechanism 582 to operate without being driven, resulting signals can be obtained that define the length of the tether 572 that passes the stationary tether management module 573. This approach could be used if it was desired to space the tether modules at predetermined distances along the tether.

In another mode, the arm mechanisms 576 and 577 can be extended and the arm mechanism 578 retracted. Energizing the roller mechanism 582 rotates the rollers to position the tether management device 573 along the tether 572. This might for example, if a tether management module 573 were added to the tether at a wellhead location and instructed to descend to a particular location based upon distance or environment.

Once positioned for assisting in tether displacement, the arm mechanisms 578 would be extended to position against the wellbore casing to fix the position of the tether management module 573. Energizing the drive for the roller mechanism 582 rotates the rollers and displaces the tether 572 thereby to constitute an intermediate drive point on the tether and reduce the maximum strain on the tether.

Thus with these various modes of operation taken singularly or in combination, it is possible to minimize the risk of breaking a tether as it is pulled into a well. Beside the inputs previously described, other sensors in the tether management module 573 could include those adapted for measuring the tension in the tether. Other sensors could utilize the angular positions of the arm mechanisms 576 and 577 to define the diameter of the wellbore casing and locate any obstructions that might exist.

From the foregoing description of different transport modules and end work devices it will be apparent that any specific embodiment of a system incorporating this invention can have a wide variety of forms. Although in a preferred embodiment each component in the system, such as a transport module and end work device, will incorporate artificial intelligence in its control, it is also possible to devise a system in which the transport module utilizes an artificial intelligence based control while the end work device does not. Conversely it is possible to produce a system in which the end work device contains an artificial intelligence based control while the transport module does not. Although the foregoing description has depicted the systems in which links exist between locations, such as the wellhead location 500 and downhole location 501 in FIG. 13, it is also possible to produce a system in which those communications are not necessary. Further the systems involving tethers such as the tether 572 in FIGS. 16 and 17 disclose tethers of a conventional cable form of a more cylindrical form. Coiled wire tethers and related devices can also be accommodated by such elements as the tether management module 573.

Figure 18:
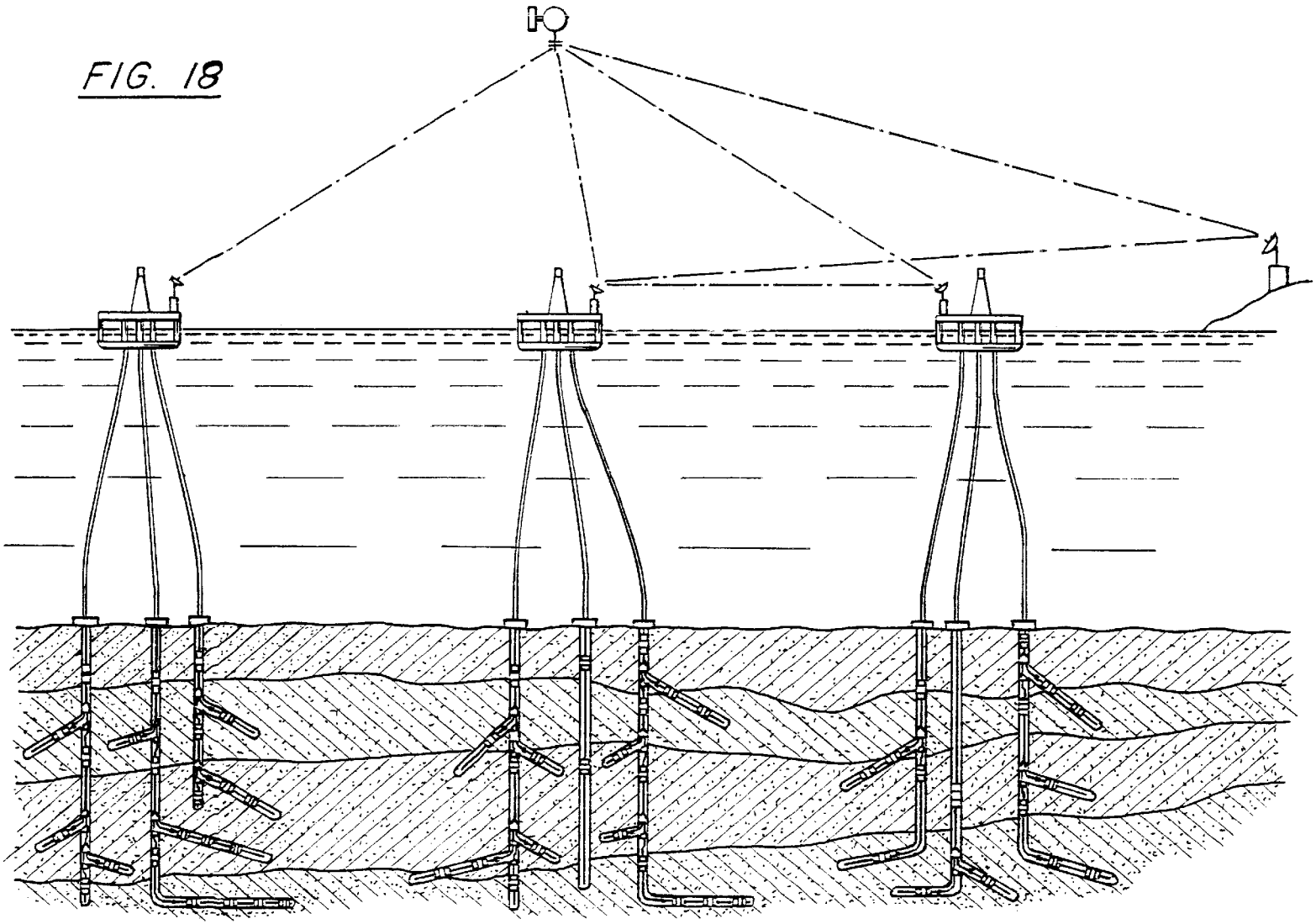
FIG. 18 is a prior art figure illustrating the environment in which the invention is employed.

The embodiment discussed above as well as those that are discussed hereinafter are employable anywhere in the downhole environment. A drawing of a typical elevation view is illustrated in FIG. 18.

A broader discussion of the invention than the foregoing embodiments provides an autonomous downhole tool whose dimensions and shape may be anything desired. Referring to FIGS. 19A–23B, the autonomous tool may include any or all of electromagnetic feet, a thruster, wheels, a screw, propeller, gears moving on a rail, etc. The tool or robot may thus cling to the casing or "fly" freely within the well fluid in a producing wellbore.

It should be understood that this tool needs no cooperating units to function and may contain artificial intelligence sufficient to act as a downhole command center traveling from place to place downhole gathering information either through its own sensors or by receiving information from other downhole sensors and making decisions to carry out certain operation and/or cause other downhole tools to carry out certain operations.

In one embodiment of the invention, upon instructions from a surface or downhole processor, the tool or robot will leave the docking station 660 (FIGS. 24–26B) and follow its preprogrammed path (aided by a forward position sensor array) to visit predetermined locales in the well, gathering information at each. The robot or tool would then return to a docking station and transmit the information to the docking station for relay to a processor uphole or downhole for evaluation. This embodiment as illustrated includes electromagnetic feet which are selectively actuatable and selectively moveable to provide forward movement.

Figure 19A:
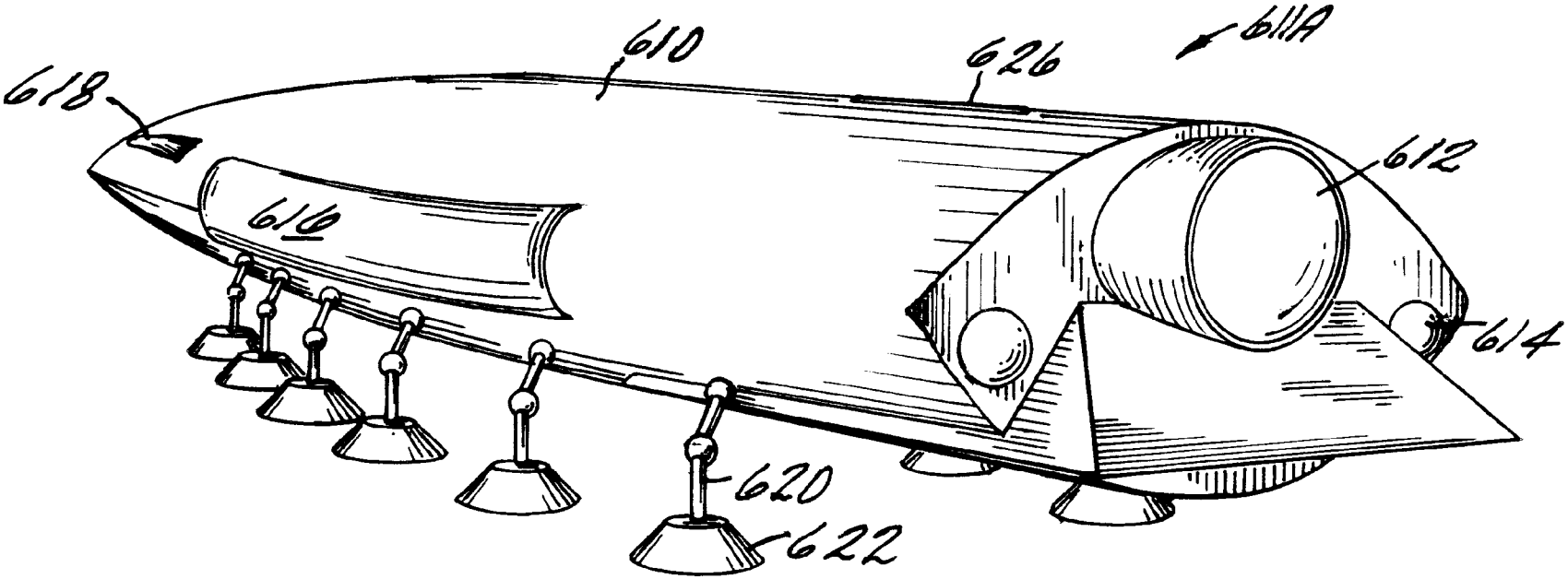
FIG. 19A is a perspective view of the moveable sensor tool of the invention for use without tracks.
Figure 19B:
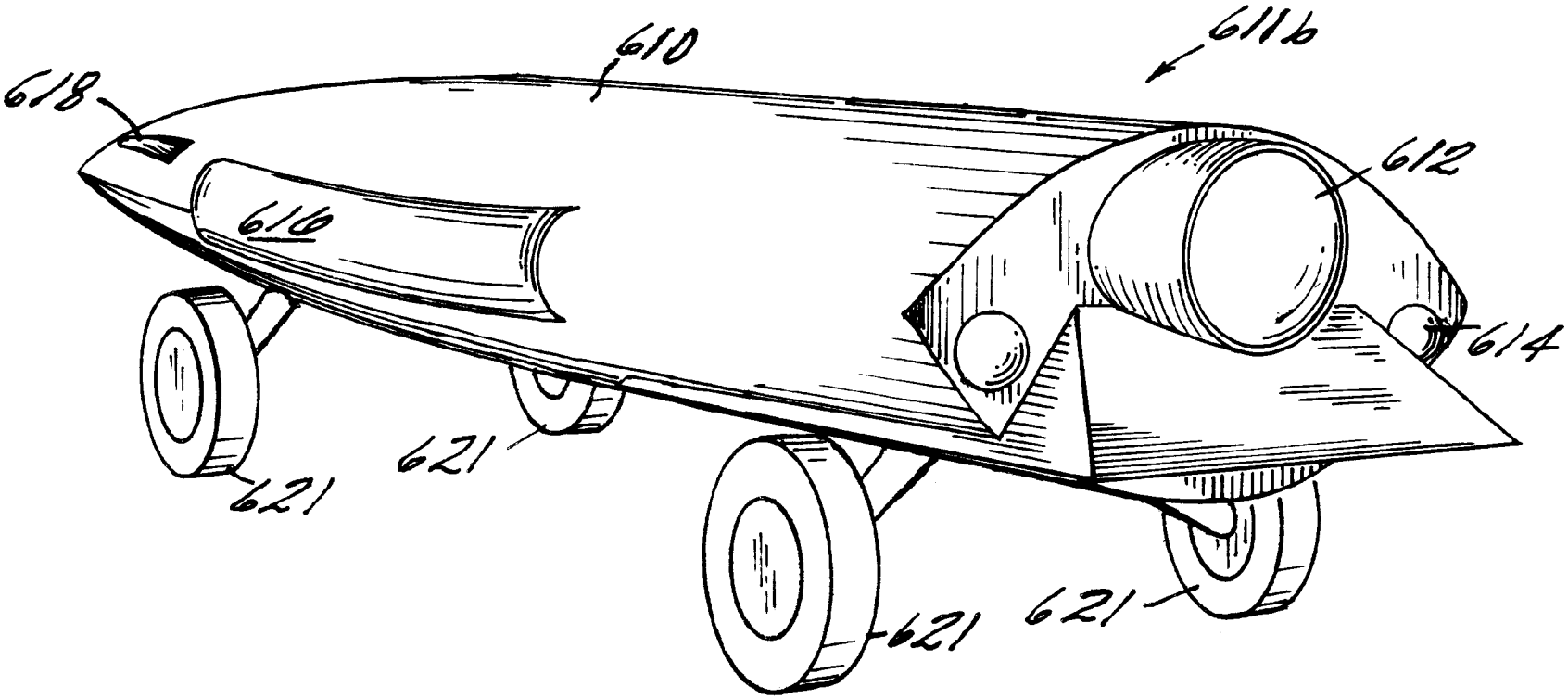
FIG. 19B is a perspective view of the embodiment of FIG. 19A substituting wheels for legs.
Figure 20A:
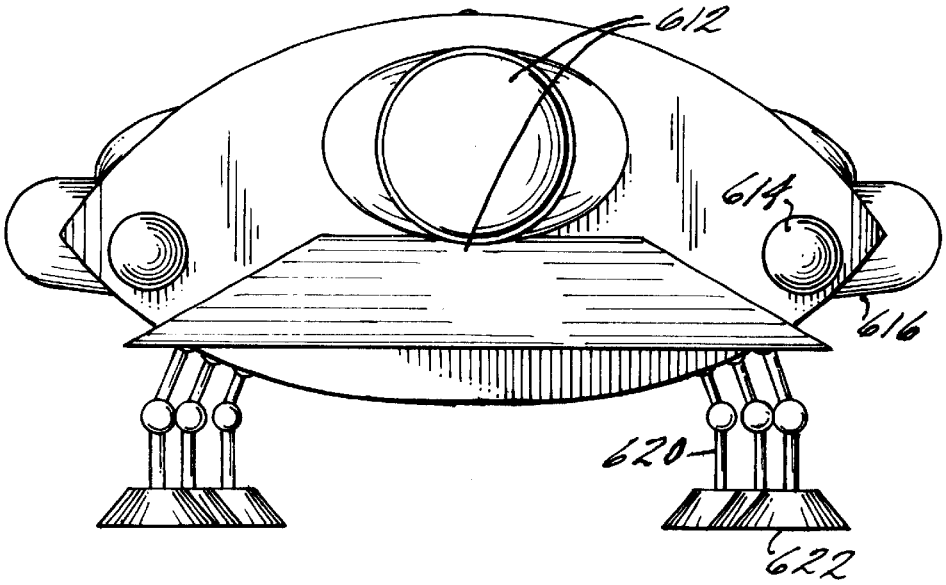
FIG. 20A is a front view of FIG. 19A.
Figure 21A:
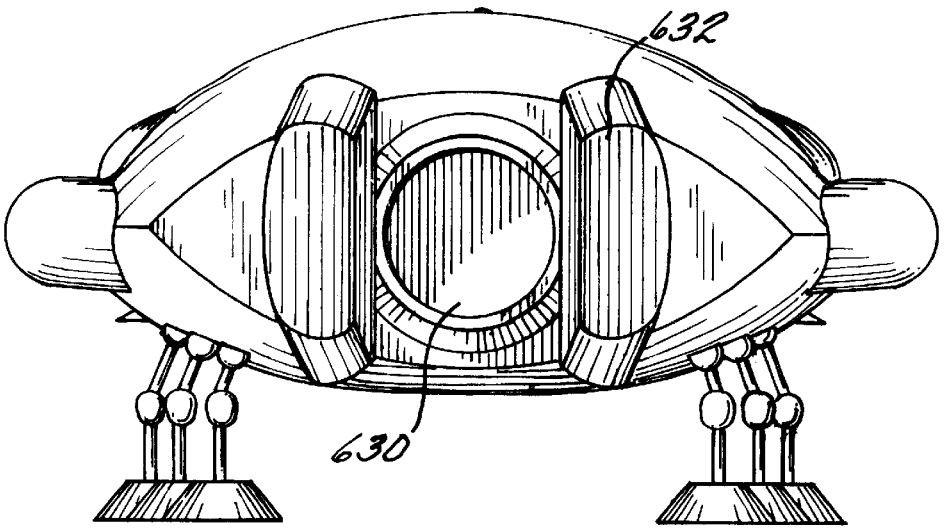
FIG. 21A is a rear view of the embodiment of FIG. 19A.
Figure 20B:
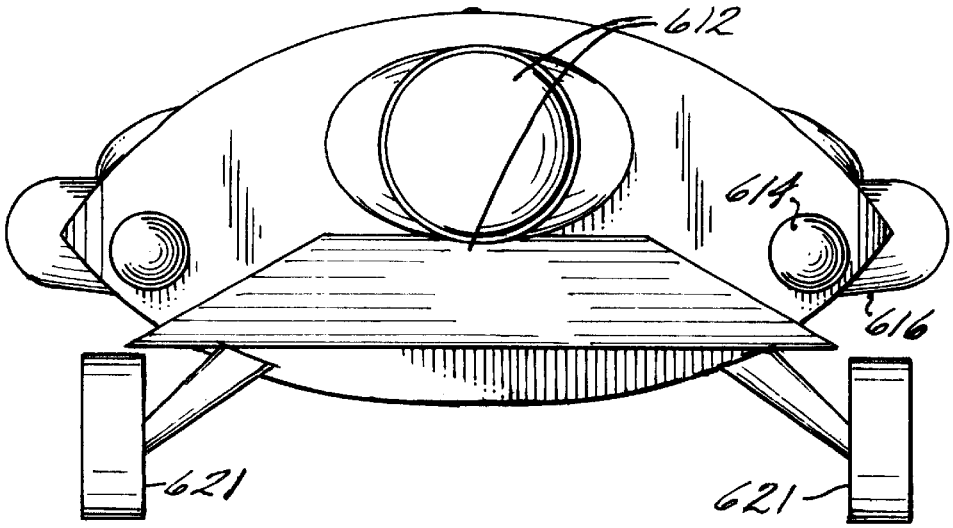
FIG. 20B is a front view of the embodiment of FIG. 19B substituting wheels for legs.
Figure 21B:
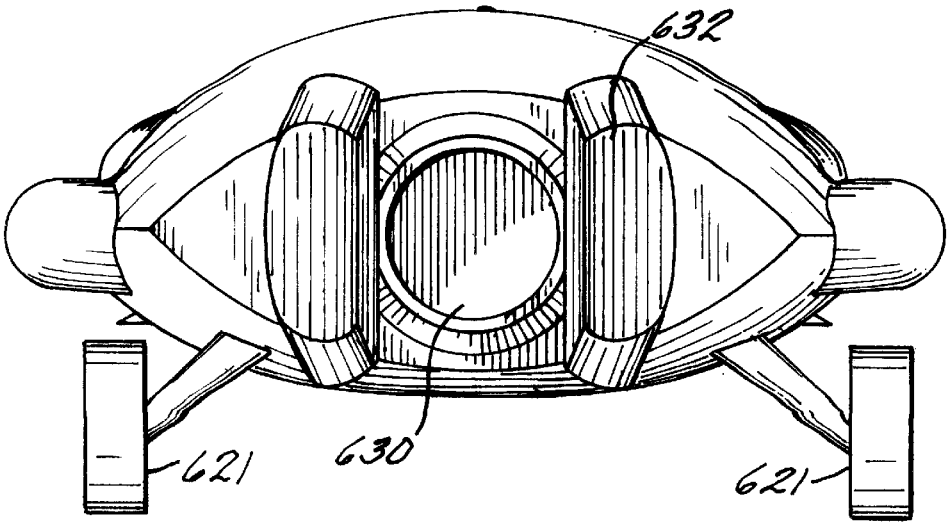
FIG. 21 B is a rear view of the embodiment of FIG. 19B substituting wheels for legs.
Figure 22A:
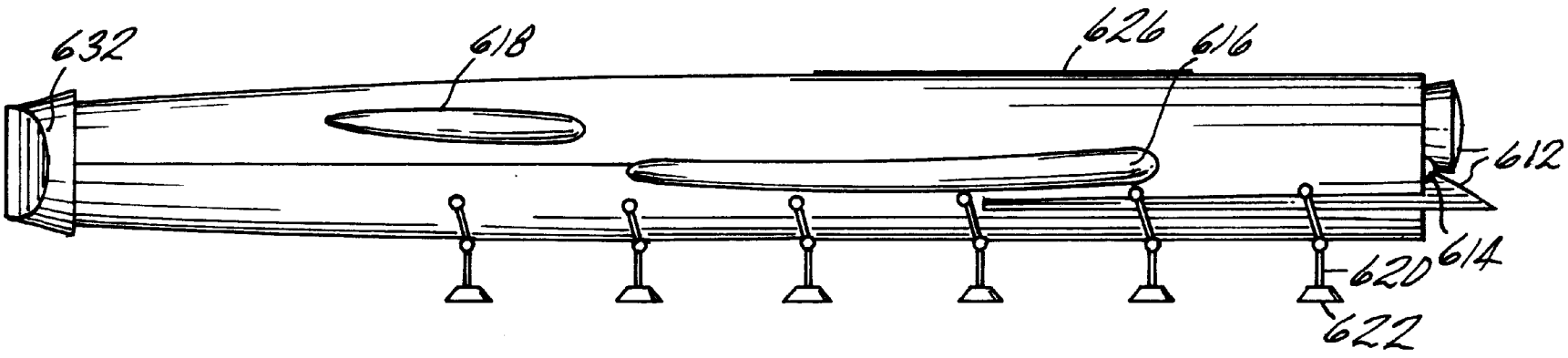
FIG. 22A is a side view of FIG. 19A.
Figure 22B:
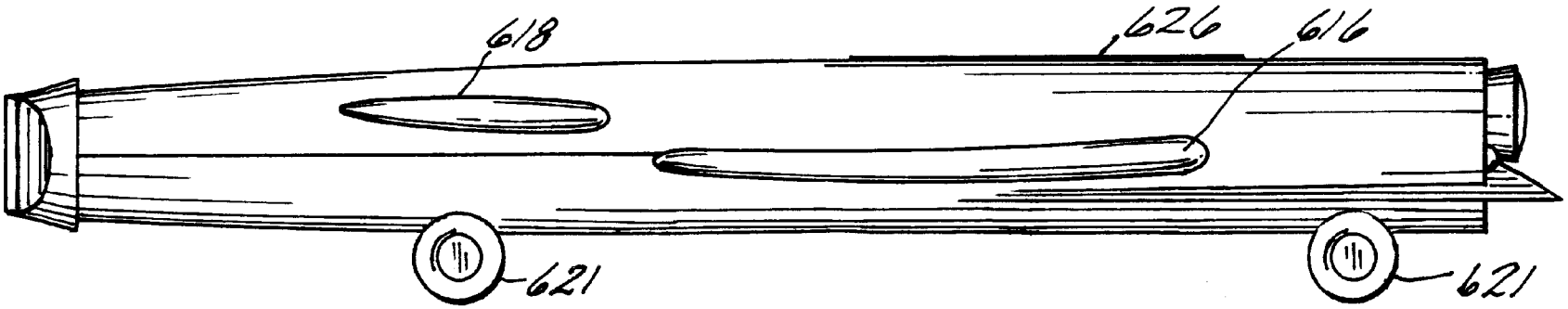
FIG. 22B is a side view of FIG. 19B.
Figure 23A:
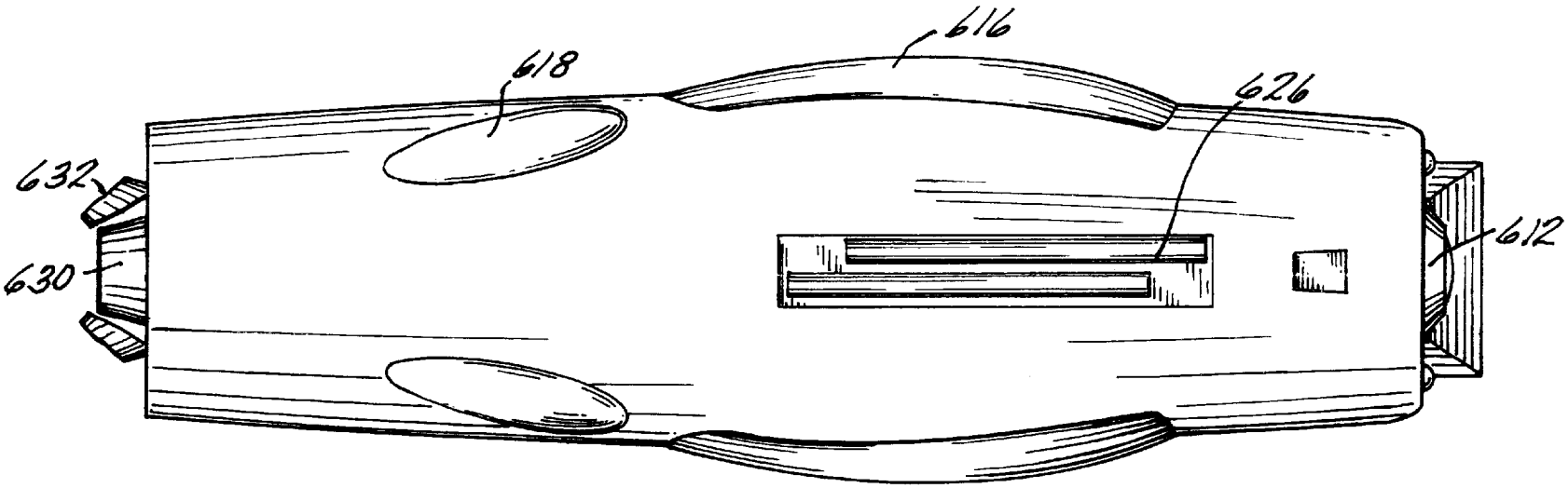
FIG. 23A is a top plan view of the embodiment of FIG. 19A.
Figure 23B:
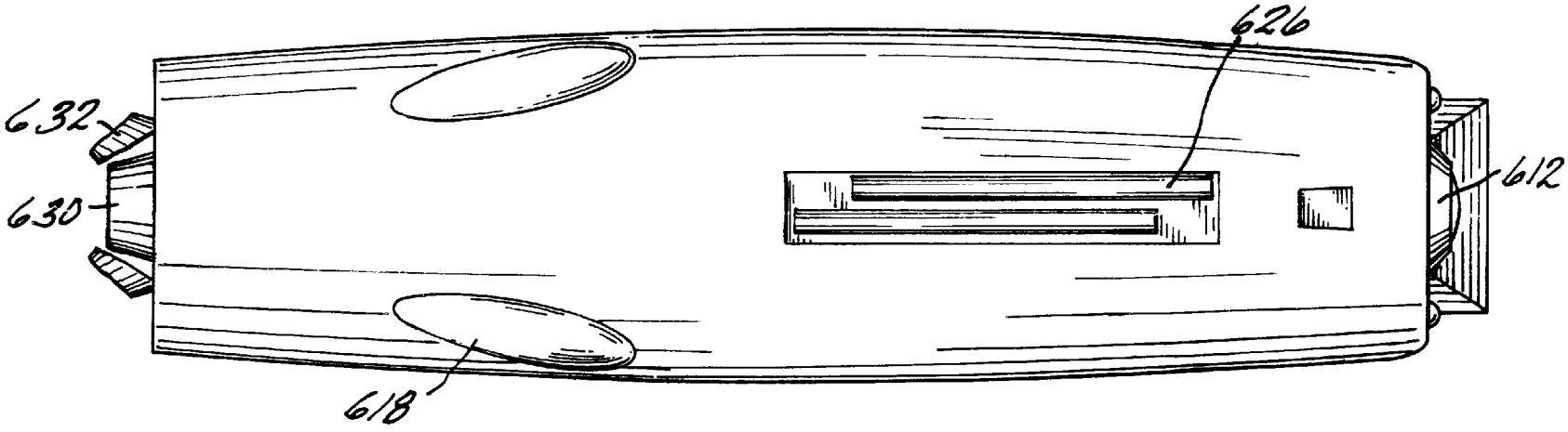
FIG. 23B is a top plan view of an alternate embodiment without the sensors.
Figure 25:
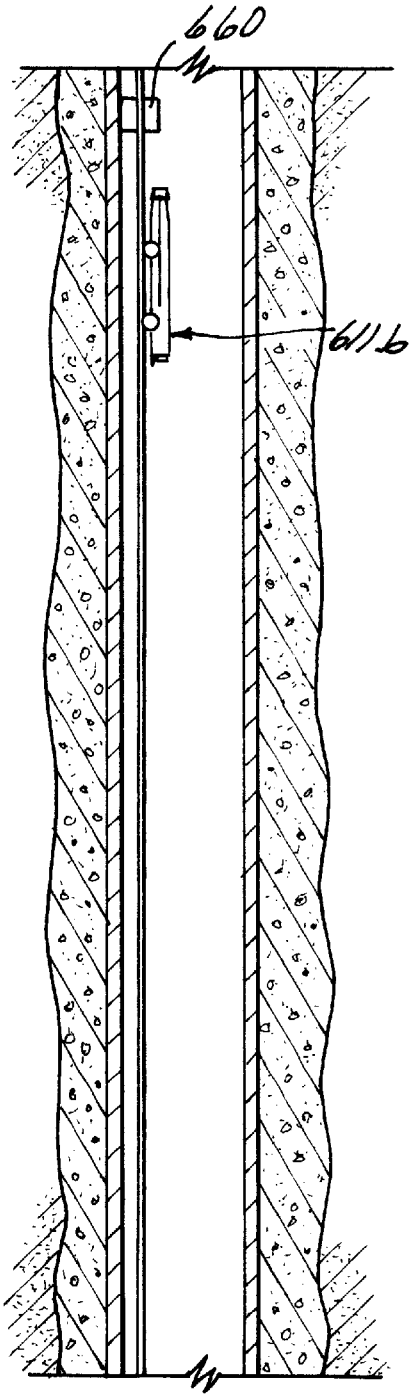
FIG. 25 is a downhole environment wherein tracks have been pre-installed wherein the tool is mounted on wheels (embodiment of FIG. 19B) adapted to engage the tracks.

In an alternate sub embodiment of the invention, the legs in the robot of FIG. 19A have been removed and replaced with a means for gripping a track, cable or rail guidance system. One of these arrangements is illustrated in FIG. 19B. It will be understood, however, that the tool or robot may be connected to the guide discussed by any method or construction which may be as simple as a collar on a cable. The tool or robot may be provided with wheels 621 or cogs adapted to engage tracks 623 (FIG. 26B) or the rail in the wall of the casing string whereby the wheels could drive the robot under motor power either with or without benefit of the thruster. Alternatively, the wheels could be undriven and the robot moved along in another manner (i.e. thruster power). Each of these provides an alternate method of movement of the robot in the downhole environment.

In another embodiment of the invention the tool does not itself carry evaluative sensors but merely visits fixed sensors 640 in the casing string, downloads information therefrom and returns to deliver the information to the docking station which is processed as noted above. Alternatively, the docking station may be eliminated by providing all communication capability and decision making capability in the autonomous tool itself. Thus, the tool handles all operations downhole without the need for instructions from another source. This is beneficial to the art because the fixed sensors, which are commercially available, do not need to be hardwired to a processor when employed as a part of the system of the invention. This embodiment includes the same sub embodiments as the foregoing embodiment.

In this embodiment the tool or robot must include data receiving modules connectable with a plurality of fixed sensors and with the docking station to transfer information. In either of the last two embodiments, a significant benefit is that the only hardwired section of the system is the docking station; nothing else need be connected. This, of course, reduces cost of completion and is thus desirable.

As indicated previously, the autonomous tools of the invention are capable of effecting downhole maintenance and repair of things in either producing or non producing wells. Because of the sensors included in the autonomous tools, and tool arms placed thereon the autonomous downhole tool may remove malfunctioning sensors or other downhole tools or parts thereof and replace them with new sensors having been previously stored downhole in, for example, a storage lateral. Securing and transporting of parts may be accomplished by the autonomous tool without assistance or may be accomplished with the assistance of a stationary device having the capability of communicating with the autonomous tool and retrieving and delivering to said autonomous tool the material or tool required or requested. This is clearly possible with all embodiments and sub embodiments of this invention. In the same vane, the stationary device could release a new autonomous tool if the first one malfunctioned. What becomes of the malfunctioning tool is discussed hereunder. In general, spare tools will be stored downhole. It is also possible, of course, for multiple tools to be stationed in the same area and repair each other or cooperate toward a particular end. One preferred set of dimensions for the autonomous downhole tool is less than about two inches in width, about one foot in length and less than about one inch in height, however, one of ordinary skill in the art will easily recognize that all of the dimensions may be altered as desired to fit particular applications.

Referring directly to FIGS. 19A, 20A, 21A, 22A and 23A, body 610 of the sensor robot of the invention includes a position sensor array 612, infrared emitters or video receivers 614, formation sensors 616, thruster intakes 618, and a plurality of legs 620 with selectively actuateably electromagnetic feet 622. Thruster 630 and thruster diverters 632 are visible in FIG. 21A. The embodiment of FIG. 19A further includes, in a most preferable arrangement, tool arms 626 located at the top of the robot such that additional hardware may be secured to the robot and transported. The embodiment of FIG. 19B (see also FIGS. 20B, 21B, 22B and 23B) carries identical equipment but has wheels 621.

Figure 27:
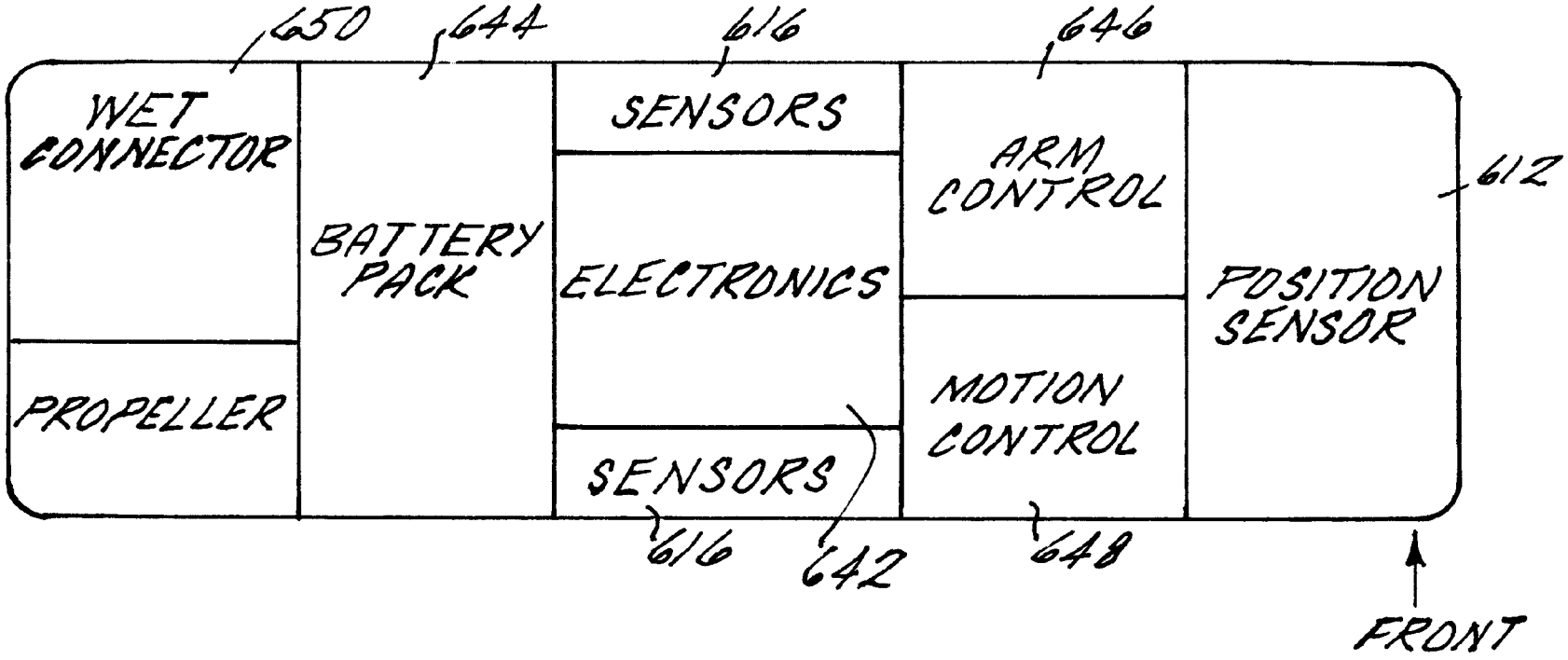
FIG. 27 is a schematic representation of the tool of the invention.

Actions of the robot are controlled by centrally located electronics 642 in the robot itself (illustrated schematically in FIG. 27). The basic electronics and software are commercially available for robots. Power is provided by battery 644. The schematic representation also provides an indication of the preferred arrangement of the other components of the robot, however, it will be appreciated that the components may be rearranged to fit particular applications. The schematic also illustrates preferred positions of arm control 646, motion control 648, wet connector 650 and propeller 652.

In practice the invention provides a docking station 660 (FIGS. 24–26) which is pre- hardwired to a downhole processor or to the surface. A robot is illustrated connected thereto. The robot will then be actuated and depending upon which embodiment is contemplated will begin collecting data from the surrounding environment or removing data from fixed sensors or both.

Figure 24:
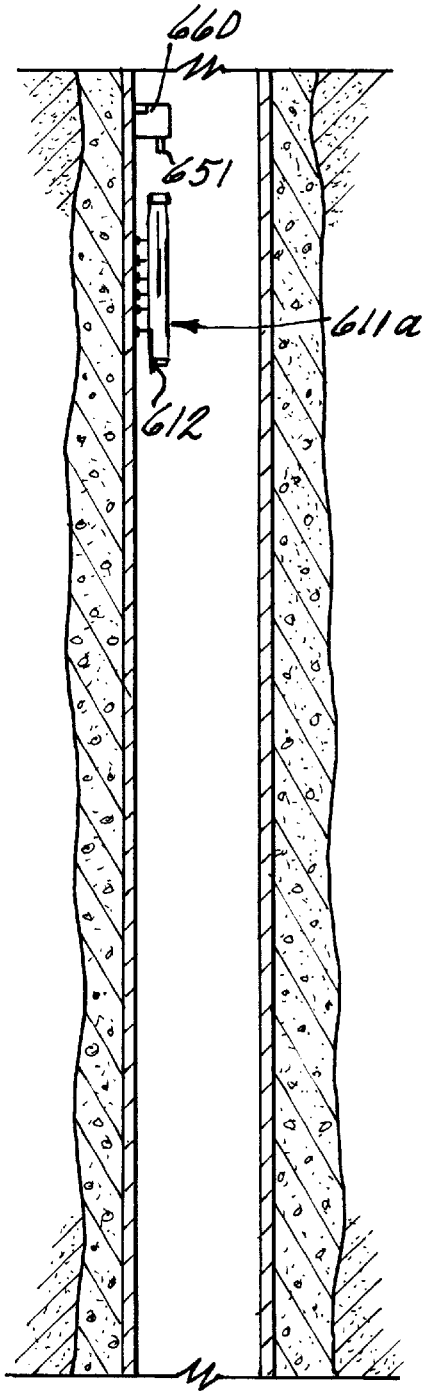
FIG. 24 is an elevation view of a downhole environment where the embodiment of FIG. 19A depicted therein.
Figure 26B:
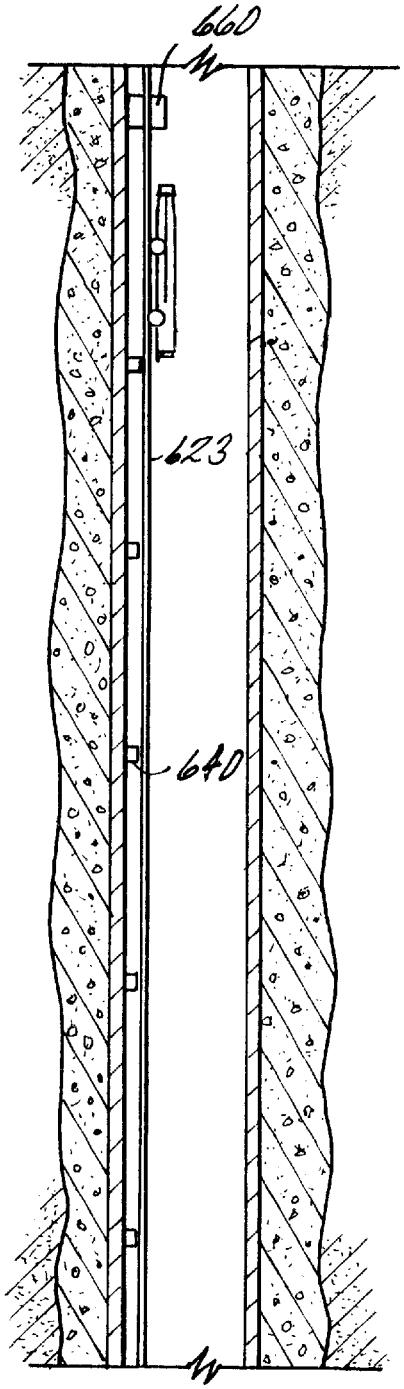
FIG. 26B adds a track to the FIG. 26A illustration.
Figure 26A:
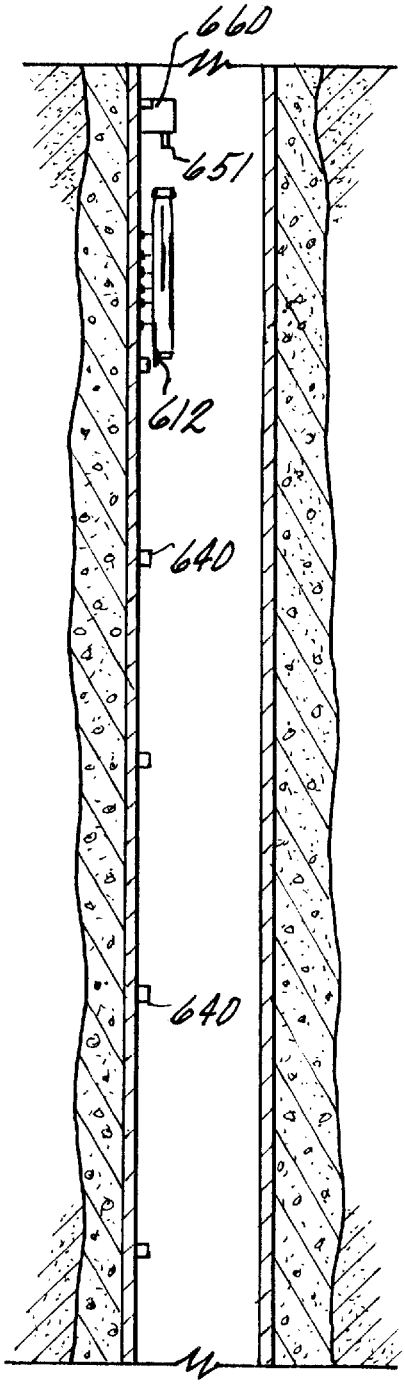
FIG. 26A is a downhole illustration of several fixed sensors and a docking station; the tool will visit each sensor and then return to the docking station to transmit information gained therefrom uphole.

Referring now to FIG. 24, the downhole environment is illustrated for a fully sensored robot (FIG. 19A). FIGS. 24A and B illustrates the fixed sensor embodiment. In both representations the docking station is illustrated schematically as a box 660. Station 660 is easily constructable by one of skill in the art through knowledge of its function. Station 660 is hardwired to either a downhole processor or a surface processor and merely is an intermediary for the transmission of data from the robot to the processor. For this purpose, the station is provided with a wet connector 651 which is matable with a complimentary connector 650 on the robot. These connectors engage when the robot returns to station 660 to deposit information. The robot is able to effect engagement of the connectors due to the position sensor array 612 located at the front of the robot which provides information about where in the well the robot is. The system is precise enough to allow efficient and reliable connection between the docking station 660 and the robot and/or fixed sensors and the robot. Instructions are also received from the station 660 while the robot is docked. It should also be appreciated that although only one station 660 is illustrated, there may be several at spaced intervals all of which are receptive to the robot. This allows more free range for the robot without very long return trips to a docking station for deposit or withdrawal of information.

While the robot is docked, it senses power availability and will recharge battery 644.

In the repair or replace mode of operation of this invention, the autonomous tool may make its own decisions or will be instructed by a processor through the intermediary of a docking station that a tool or sensor is malfunctioning. The robot will power itself up from the low power resting status it is in while docked and will proceed to the designated location to repair the problem. Depending upon how many tool arms are provided on the robot, the robot may proceed first to the malfunctioning tool, remove this tool, then proceed to the storage site to trade the damaged tool for a new one and bring the new tool to the appropriate site for installation. The robot could then return to the dock to report completion of the task.

Alternatively, if the robot is equipped with sufficient tool arms it may visit the storage depot first to retrieve a new tool then proceed to the malfunctioning tool site remove the tool (requires a second set of tool arms) and install the new tool; return to docking station and report completion of task. This alternative allows fewer traversing movements to complete the task and additionally allows for reprogramming of the malfunctioning tool (if possible) at the docking station prior to storage.

In another embodiment of the invention, the autonomous tool of the invention is also another kind of tool. More specifically, the autonomous tool may in fact be a self locating and self deploying packer, anchor, plug, valve, choke, diverter, etc. In this embodiment the autonomous circuits of the tool of the invention seek out and find the proper location for deployment according to either preprogrammed instructions or by the autonomous tool's own sensory input. As an example, the tool of the invention moves in the downhole environment searching for a desired or preprogrammed place for deployment. When the tool finds the appropriate place it signals deployment and the packer inflates. The autonomous tool has thus finished its job and is permanently installed to do the job of the packer.

Another feature of the invention is a self destruct feature to ensure that the autonomous tool of the invention cannot itself become a maintenance problem. A malfunctioning robot or tool, as will immediately be appreciated by one of ordinary skill in the art, might become problematic by becoming lodged in another downhole tool as or the wellbore thus inhibiting production. In order to remove such possibility, the autonomous downhole tool of the invention is manufactured to self destruct upon any of several circumstances.

Three embodiments are envisioned for a self destruct feature:

1) build the autonomous tool from materials having a finite lifespan once in contact with wellbore fluids;

2) employ weak electromagnetivity to hold pieces of the tool together which will fail and allow the tool to separate into small pieces when the power source dwindles;

3) carry explosive material on-board the tool which is ignited either automatically or upon command to "blow" the tool into small pieces.

Any of the three embodiments may be self triggering if for example the robot encounters information from its own sensors or gathered from fixed sensors indicating a condition in which the robot should be removed or at any time that the programming of the tool leaves it unable to determine a proper course of action. In this event, the robot should be terminated to avoid becoming a maintenance difficulty. Once the robot has been reduced to small parts, they are easily removed in the fluids.

While preferred embodiments have been shown and described it is to be understood that the discussion is illustrative and is not intended to limit the scope of the invention.

We claim:

1. An autonomous downhole oilfield tool comprising:

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore; and g) an end work device associated with the body performing a desired function downhole h) other equipment operatively associated with the well bore having communications capability; and i) communications equipment associated with said body for communicating with said other equipment.

2. A downhole tool as set forth in claim 1 wherein said communications equipment associated with the body includes a transmitter for transmitting data to a receiver associated with other equipment operatively associated with the wellbore.

3. A downhole tool as set forth in claim 2 wherein the other equipment is selected from the group comprising a surface controller, a transceiver, downhole mechanical equipment, downhole sensors and a docking station.

4. A downhole tool as set forth in claim 1 wherein said communications equipment associated with the body includes a receiver for receiving data from a transmitter associated with other equipment operatively associated with the wellbore.

5. A downhole tool as set forth in claim 4, wherein the other equipment is selected from the group comprising a surface controller, a transceiver, downhole mechanical equipment, downhole sensors and a docking station.

6. A downhole tool as claimed in claim 1 wherein said end work device comprises at least one carrier detachably securing and transporting downhole equipment from a first location in the wellbore to a second location.

7. A downhole work system comprising:

a) at least one autonomous downhole tool as claimed in claim 6;

b) at least one stationary device in the wellbore having the ability to communicate with the autonomous tool and having access to equipment deliverable to said autonomous tool to facilitate said autonomous tool in carrying out a desired operation.

8. A downhole tool as claimed in claim 1 wherein said end work device comprises at least one mechanical tool performing mechanical operations on structures in the wellbore.

9. A downhole tool as claimed in claim 1 wherein said end work device comprises at least one sensor monitoring data in the wellbore, said sensor being selected from the group consisting of formation sensors, wellbore production fluid parameter sensors, and wellbore equipment sensors.

10. A downhole tool as claimed in claim 9 wherein said at least one sensor is an imaging system.

11. A downhole tool as set forth in claim 1 wherein the body and end work device together form an item of downhole equipment and operate with the wellbore structure to perform the desired function.

12. A downhole tool as claimed in claim 11 wherein said downhole equipment is selected from the group consisting of an autonomous packer, anchor, plug, valve, choke and diverter.

13. A downhole tool as claimed in claim 1 wherein said power source is self contained in association with said body of said tool.

14. A downhole tool as claimed in claim 1 wherein said transport mechanism utilizes magnetic propagation.

15. A downhole tool as claimed in claim 1 wherein said transport mechanism utilizes mechanical propagation.

16. A downhole tool as claimed in claim 1 wherein said transport mechanism utilizes fluid propagation.

17. A downhole tool as claimed in claim 1 wherein said tool further includes a self-destruct mechanism breaking the body into small parts.

18. A downhole work system comprising:

a plurality of the downhole tools as claimed in claim 1, with at least two of said plurality of downhole tools including a communications system, said communications system communicating with a plurality of other said downhole tools to accomplish a desired end.

19. A downhole work system comprising:

a delivery system delivering the downhole tool of claim 1 to a predetermined location downhole and releasing the tool of claim 1 at said predetermined location.

20. The tool according to claim 1, wherein:

the end work device is selected from a group consisting of a cutting device, milling device, welding device, explosive device, testing device, devive that is adapted to operate a preexisting device in the wellbore, formation evaluation device, charged-coupled device, perforating device, workover device, chemical injection device, testing device including a device to measure temperature, pressure, fluid flow rate, device to test the chemical properties of downhole fluids, device to test the physical properties of the fluids, a data gathering device, a device adapted to move materials within the wellbore, and a device to operate a preexisting device in the wellbore.

21. A monitoring control and work system for use in a wellbore comprising:

A) an autonomous tool for operating in the wellbore including:

i) a body adapted to be delivered into a wellbore from the surface and be resident in the wellbore;

ii) a source of electrical power operatively associated with the body;

iii) at least one sensor associated with the body monitoring at least one operating parameter of the tool relative to its environment;

iv) a microprocessor associated with the body receiving data from the sensor;

v) a memory associated with the microprocessor providing information for operating instructions to the body;

vi) a transport mechanism controlled by the microprocessor and moving the body within the wellbore; and f) an end work device associated with the body performing a desired function downhole; and B) a docking station mounted in the wellbore at a predetermined location, said docking station cooperating with said autonomous tool to provide electrical power and data to the tool.

22. A monitorinh control and work system as claimed in claim 21 further including a guide for guiding said autonomous tool as it moves in the wellbore.

23. A monitoring control and work system as claimed in claim 21 wherein said autonomous tool is tethered to the docking station.

24. A downhole tool as claimed in claim 21 wherein said tool is electrically tethered to a remote point in the wellbore.

25. A downhole tool as claimed in claim 21 wherein said autonomous tool is a primary tool and includes cooperating secondary autonomous devices which are connected to said tether, said secondary devices traveling along said tether to a location defined by a predetermined set of parameters and then anchoring to a casing of a wellbore and causing said tether to feed therethrough to facilitate reduction of drag from said tether on said primary tool.

26. A downhole tool as claimed in claim 25 wherein said secondary autonomous devices include independent controllers.

27. A downhole monitoring and control system as claimed in claim 26 wherein said docking station includes a communication link to surface side or antoher location.

28. A downhole tool as claimed in claim 25 wherein said secondary autonomous device include tension measurement capability for measuring tension on said tether.

29. A downhole monitoring and control system for zone in a production well, comprising:

a) at least one fixed sensor in said zone;

b) at least one data gathering tool movable within said zone, said tool including an information uploader and downloader for communicating with said at least one fixed sensor.

30. A downhole monitoring and control system as claimed in claim 29 wherein said system further includes a docking station mounted within the wellbore capable for communicating with said data gathering tool.

31. A downhole device as claimed in claim 29 including a controller, said controller including programming to act as a command center for controlling downhole operations.

32. A downhole monitoring and control system as claimed in claim 29 wherein said wellbore has a plurality of fixed sensors.

33. An autonomous downhole oilfield tool comprising;

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore;

g) at end work device associated with the body performing a desired function downhole, said end work device comprising at least one carrier detachably securing and transporting downhole equipment from a first location in the wellbore to a second location.

34. A downhole work system with at least one autonomous downhole tool as claimed in claim 33, and at least one stationary device in the wellbore having the ability to communicate with the autonomous tool having to facilitate said autonomous tool in carrying out a desired operation.

35. An autonomous downhole oilfield tool comprising:

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore; and j) an end work device associated with the body performing a desired function downhole, said end work device comprising at least one sensor monitoring data in the wellbore, said sensor being selected from the group consisting of formation sensors, wellbore production fluid parameter sensors, and wellbore equipment sensors.

36. A downhole tool as claimed in claim 35 wherein said at least one sensor is an imaging system.

37. An autonomous downhole oilfield tool comprising:

a) a body adapted to be delivered into wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) a memory asociated with the microprocessor providing information for operating instructions to the body;

f) transport mechanism controlled by the microprocessor and moving the body within the wellbore by utilizing magnetic propagation; and g) an end work device associated with the body performing a desired function.

38. An autonomous downhole oilfield tool comprising:

a) a body adapted to be delivered into wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving within the wellbore by utilizing fluid propogation; and g) an end work device associated with the body performing a desired function downhole.

39. An autonomous downhole oilfield tool comprising:

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore;

g) an end work device associated with the body performing a desired function downhole; and h) a self-destruct mechanism breaking the body into small parts.

40. An autonomous downhole oilfield tool comprising:

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore; and g) an end work device associated with the body performing a desired function downhole the end work device is selected from a group consisting of a cutting device, milling device, welding device, explosive device, testing device, device that is adapted to operate a preexisting device in the wellbore, formation evaluation device, charge coupled device, perforating device, workover device, chemical injection device, testing device including a device to measure temperature, pressure, fluid flow rate, device to test the chemical properties of downhole fluids, device to test the physical properties of the fluids, a data gathering device, a device adapted to move materials within the wellbore, and a device to operate a preexisting device in the wellbore.

* * * * *